US009840313B2

(12) United States Patent
Cioanta et al.

(10) Patent No.: US 9,840,313 B2
(45) Date of Patent: Dec. 12, 2017

(54) CLEANING AND GROOMING WATER SUBMERGED STRUCTURES USING ACOUSTIC PRESSURE SHOCK WAVES

(71) Applicant: SANUWAVE, INC., Alpharetta, GA (US)

(72) Inventors: Iulian Cioanta, Milton, GA (US); Cary McGhin, Sugar Hill, GA (US)

(73) Assignee: SANUWAVE, INC., Suwanee, GA (US)

( * ) Notice: Subject to any disclaimer, the term of this patent is extended or adjusted under 35 U.S.C. 154(b) by 0 days.

(21) Appl. No.: 15/264,721

(22) Filed: Sep. 14, 2016

(65) Prior Publication Data

US 2017/0081000 A1 Mar. 23, 2017

Related U.S. Application Data

(60) Provisional application No. 62/221,818, filed on Sep. 22, 2015, provisional application No. 62/265,035, filed on Dec. 9, 2015.

(51) Int. Cl.

| | |
|---|---|
| ***B63B 59/00*** | (2006.01) |
| ***B63B 59/10*** | (2006.01) |
| ***B63B 59/08*** | (2006.01) |
| ***B06B 1/02*** | (2006.01) |
| ***B08B 3/02*** | (2006.01) |
| ***B08B 3/12*** | (2006.01) |
| ***E02B 17/00*** | (2006.01) |
| *B08B 7/02* | (2006.01) |

(Continued)

(52) U.S. Cl.

CPC ..... *B63B 59/10* (2013.01); *B06B 1/02* (2013.01); *B08B 3/024* (2013.01); *B08B 3/12* (2013.01); *B63B 59/08* (2013.01); *E02B 17/0034* (2013.01); *B08B 5/04* (2013.01); *B08B 7/026* (2013.01); *B08B 2203/0229* (2013.01); *H04R 1/44* (2013.01)

(58) Field of Classification Search

CPC ..... B63B 59/10; B63B 59/08

See application file for complete search history.

(56) References Cited

U.S. PATENT DOCUMENTS 4,410,825 A * 10/1983 Lobastov ..... G01L 5/14 310/327

4,502,407 A 3/1985 Stevens (Continued)

FOREIGN PATENT DOCUMENTS

| | | | |
|---|---|---|---|
| CN | 103895835 | A | 7/2014 |
| WO | 2010/048038 | A2 | 4/2010 |

OTHER PUBLICATIONS

PCT International Search Report, ISA/US, Commissioner for Patents, International Application No. PCT/US16/51587, dated Feb. 3, 2017, pp. 1-5.

(Continued)

*Primary Examiner* — Stephen P Avila

(74) *Attorney, Agent, or Firm* — Hunton & Williams LLP

(57) ABSTRACT

A cleaning or grooming system that uses acoustic pressure shock waves can remove barnacles, algae, biofilms and other undesired materials from the hulls of ships, propellers, rudders, inlet ports for cooling of nuclear submarines, outlet ports, sonar housings, protective grills and other structures that are submerged in salt or fresh water environments.

24 Claims, 17 Drawing Sheets

(51) Int. Cl.
*B08B 5/04* (2006.01)
*H04R 1/44* (2006.01)

(56) References Cited

U.S. PATENT DOCUMENTS

| | | | | |
|---|---|---|---|---|
| 5,636,180 | A | 6/1997 | Grothaus et al. | |
| 5,852,984 | A | 12/1998 | Matsuyama et al. | |
| 5,978,405 | A * | 11/1999 | Juhasz | H01S 3/036 372/102 |
| 6,224,476 | B1 * | 5/2001 | Long | A22C 9/002 426/238 |
| 9,095,632 | B2 | 8/2015 | Cioanta et al. | |
| 2004/0074431 | A1 * | 4/2004 | Tible | B63B 59/10 114/222 |
| 2008/0228112 | A1 * | 9/2008 | Voss | A61B 17/2251 601/4 |
| 2011/0196268 | A1 * | 8/2011 | Smith | A61B 17/2255 601/4 |
| 2012/0317750 | A1 * | 12/2012 | Ostervold | B08B 3/024 15/415.1 |
| 2014/0230713 | A1 | 8/2014 | Kimura et al. | |
| 2014/0305877 | A1 | 10/2014 | Cioanta et al. | |

OTHER PUBLICATIONS

PCT Written Opinion of the International Searching Authority, International Application No. PCT/US16/051587; dated Feb. 3, 2017, pp. 1-8.

Wang, Ching-Jen, MD: An Overview of Shock Wave Therapy in Musculoskeletal Disorders, Apr. 2003, Department of Orthopedic Surgery, Chang Gung Memorail Hospital, Kaoshiung; Chang Gung Med J, vol. 26, No. 4.

* cited by examiner

CLEANING AND GROOMING WATER SUBMERGED STRUCTURES USING ACOUSTIC PRESSURE SHOCK WAVES

CROSS-REFERENCE TO RELATED APPLICATIONS

This application claims the benefit of priority of U.S. provisional application No. 62/221,818, filed Sep. 22, 2015, and U.S. provisional application No. 62/265,035, filed Dec. 9, 2015, all of which are incorporated herein by reference.

BACKGROUND OF THE INVENTION

It is well understood that vessels or structures that in part reside below the surface of sea water or fresh water are subjected to various levels of fouling by marine (salt water) or aquatic (fresh water from lakes and rivers) organisms, respectively. Vessels such as boats, ships, or submarines require routine removal (cleaning) of fouling such as algae, weed, barnacles, mollusks, etc., in order to maintain the performance or even the function of the vessel. At the base of the fouling mechanism for vessels and structures residing in sea or fresh water are the biofilms formed on such structures that constitute the glue between marine or aquatic organisms and the actual structure. The biofilms form and the fouling-organisms attach to all subsurface structures and as a result the more diverse or intricate the structure (such as propellers, rudders, inlet and outlet ports, sonar housings, protective grills, etc.) the more difficult and costly to remove the biofilms and these organisms. Fouling is a major problem, leading to higher fuel consumption and consequently increased air pollution. It can also cause the spread of alien species that do not belong in the local marine environment. The type of paint or coatings applied to the vessel or structures also change the types of fouling. The economic impact of fouling is very high too. For example, in the US Navy the propeller cleaning is recommended up to six times a year and hull cleaning or grooming is recommended up to three times a year.

The fouling of platform structures below the water's surface such as pilings and beams creates an uneven water flow around the supporting features, which causes an uneven pressure distribution throughout the structure leading to material stresses and the potential for collapse of the platform. In conclusion a system that can perform a thorough grooming, meaning the removal of the biofilm(s) from structures and vessels, prevents the organisms from growing to a size that affects the vessel or structure's function or performance, which will require cleaning (removal of microorganisms and biofilms).

The cleaning or grooming of a marine (salt water) or aquatic (fresh water) vessel or structure (such as oil platforms) generally involves methods that use brushes, scrapers, other abrasive means to clean and very high pressure water sprays. Abrasive methods can be damaging to the welds and rivets of the water vessels or underwater structures compromising their mechanical integrity. Some of these methods require that the water vessel be dry-docked, which is a not only a large expense but a risk to the structure of the vessel each time it is removed from the water. Present cleaning or grooming methods are labor intensive and fall short of being thorough, leaving behind the biofilms, which represent the substrate and hold the nutrients that different salt water or fresh water organisms use for growth and anchor. Due to this drawback, the actual marine (salt water) or aquatic (fresh water) vessels or structures will need cleaning more often. These other methods also tend to remove one or more surface layers of coatings or paint protecting the vessel or platform structure, which can requires that it be recoated or repainted. When the cleaning or grooming is performed below water surface another drawback may occur due to the fact that removed coatings or paint from the ship can be toxic for the surrounding marine or aquatic life.

Patents US 2005/0199171, US 2012/0006244, US 2013/0298817 and US 2014/0230711 present different systems and methods that use brushes to clean ship hulls. These systems can be used without the necessity of dry docking the ship. These patent publications present support frames with articulated arms or movable chassis/frames that help the brushes to reach the actual area that needs to be cleaned. These systems are complicated, expensive, labor intensive and can be dangerous to divers. Furthermore, it is well known that the brushes also remove a significant amount of the anti-fouling paint (a third of the paint coating can be gone during cleaning or grooming process), which can significantly increase the cost of cleaning or grooming, due to the necessity of re-painting of the hull.

A robotically operated device that uses an ultrasonic transducer for cleaning of ships' hulls is presented in U.S. Pat. No. 4,890,567. This device was designed to be used during dry-dock cleaning of a ship and also can be used to spray paint on the hull after cleaning. The cavitation generated by the negative pressure of the ultrasound is thought to be the main mechanism that produces the hull cleaning. However, the ultrasound by its nature has a weak negative pressure (this pressure generates cavitational bubbles) and is immediately followed by the tensile (positive pressure), which collapse the cavitation bubbles before reaching their maximum size and thus full cleaning power. This is why this method is less effective, labor intensive and requires the dry-docking of the ship, which dramatically increases the cost.

High pressure water sprays systems for cleaning ship hulls (U.S. Pat. No. 6,595,152) or pile cleaning of submerged structures (U.S. Pat. No. 8,465,228) represent popular systems that are used for cleaning of marine (salt water) or aquatic (fresh water) vessels or structures. The disadvantage of these systems is the high operating pressures that can be dangerous for the divers and damaging to the actual structures that need to be cleaned. Not to mention that these systems require bulky installations and a lot of safety features to make them as safe as possible.

A "cavitation (negative pressure) jet" technology has been developed, such as described in U.S. Pat. No. 7,494,073, for use in cleaning surfaces underwater, with the added benefit of removing little to none of the coatings or paint layers, and therefore making the cleaning process of little to no contamination risk to the surrounding marine environment. However, this is a hand-held system by a diver that was designed for action on small surfaces (due to the nature of jet technology) and still requires a labor intensive operation to accomplish the desired results. Larger systems were created by Russians that are called "cavitators". These systems rely only on hydrodynamic cavitation bubbles that collapse and send so-called localized "shock waves" towards the surface in need of cleaning. Due to high pressures used for the jets providing flowing liquid and gas that generate the cavitation, the cavitation bubbles do not have an optimum environment to develop to their full potential (high pressures from outside the bubbles prevent them to grow to their largest dimension, which translates in less energy put in the so-called "shock waves" produced during their collapse), which reduces significantly their efficiency. In other words, the smaller the pressure outside the cavitation bubbles (unpressurized liquid) the larger the bubbles will grow until the pressure inside the bubbles is higher than the pressure outside the bubbles, which will initiate their collapse capable of generating much more efficient high pressure jets.

All of the above alternatives for cleaning or grooming underwater structures or ship hulls rely on the support of a remotely operated "underwater" vehicle (ROV). The ROV is commercially fabricated for various purposes including underwater applications. These ROVs allow underwater navigation while being remotely controlled above water surface. Remote navigation is possible since ROVs contain onboard cameras and underwater lighting systems to transmit live images of the environment surrounding the ROV to the above surface station/control station. The ROVs are equipped with thrusters to propel the ROV through the water and contain wheels, traction grip tracks, or other traction means such as controlled suctioning or controlled magnetic attraction to move along a surface. There are particular commercial ROVs that can maintain direct contact with an underwater structure while traversing alongside it, even beyond vertical. These highly developed and capable ROVs require extensive technical expertise [refer to patents U.S. Pat. No. 8,886,112, US 2011/0083599, US 2013/0263770, US 2014/0076224 A1, US 2014/0076225 A1, and US 2014/0081504 A1] to support their unique capabilities, which is not in the scope of this invention.

SUMMARY OF THE INVENTION

The present invention is proposing a ship's hull and underwater structures cleaning or grooming apparatus employing acoustic pressure shock waves that can provide high compressive pressures (pressures in excess of 100 MPa/1000 bar) followed by large and long lasting tensile/negative pressures (in excess of 10 MPa/100 bar), which can generate large cavitational bubbles producing during their collapse very powerful water jets with speeds in excess of 100 m/s. These two synergetic phase effects of the acoustic pressure shock waves are capable of working in tandem for cleaning or grooming ships' hull or any underwater structures subject to marine or aquatic biofilms formation and subsequently to marine or aquatic fouling.

Compared to "cavitation jet" technology based on flowing liquid and hydrodynamic cavitation, the acoustic pressure shock waves of the present invention produce much stronger and larger scale shock waves that move with the speed of sound. As mentioned above, these acoustic pressure shock waves have a compressive phase (pressures in excess of thousands of bar) followed by a long tensile phase that creates significantly larger cavitation bubbles capable of producing during their implosions (collapses) water jets with speeds in excess of 100 m/s combined with localized ultra-high pressures and high temperatures. Thus, the acoustic pressure shock wave technology produces a "double punch" effect, and it is capable of much higher efficiency during cleaning or grooming process when compared to "cavitation jet" technology.

The present invention describes non-contact and non-abrasive acoustic pressure shock waves cleaning or grooming apparatuses, which are also compatible and potentially non-destructive to paints or coatings, including antifouling or environmental coatings applied to the water vessel or underwater structure, which is an important financial and environmental benefit. These acoustic pressure shock wave systems are capable of removing the layers of marine or aquatic fouling down to the biofilms that have become bonded to the subsurface structures. Furthermore, the application of acoustic pressure shock waves is most significant on removing the aquatic or marine biofilms, which are the source of fouling, without destroying the integrity of the underlying structure/substrate (grooming of marine (salt water) or aquatic (fresh water) vessels or structures). This would reduce the need to use antifouling coatings that only slow down the biofilm growth without eliminate it. Furthermore, the antifouling toxic coatings/paints incorporate copper, heavy metals and other biocides, which when released into surrounding marine or aquatic environment can pose a danger to the local marine or aquatic life. Thus, the acoustic pressure shock waves cleaning or grooming apparatuses described in the embodiments of this invention can eliminate or reduce the negative environmental impact produced by existing technologies used for the cleaning or grooming of fouling on ships' hull or any underwater structures.

There are different degrees of fouling, depending on the material (metal, fiber glass, plastics, wood, cement, etc.) and/or external paint or coating of the surface being cleaned. The fouling organisms can be extremely bonded to the structure such that to remove these organisms and the biofilm layer will sometimes result in removing some of the surface coating, and if the coatings are toxic would require proper containment. This is why the present invention also provides a means to contain the cleaning or grooming waste and therefore reducing the likelihood of posing a danger to the surrounding marine (salt water) or aquatic (fresh water) life. The inflatable bladder of the present invention provides a sufficient seal between the cleaning or grooming apparatus and the working surfaces so that the debris can be collected, pumped away and render them harmless through filtering by topside managing systems.

Acoustic pressure shock wave technology being a non-contact technology can easily protect the structural integrity of rivets, welds, indents, which if affected by the cleaning or grooming process can compromise the integrity of the hulls or underwater structures. Furthermore, by adjusting the focusing (deep or shallow) of the acoustic pressure shock waves apparatuses, the cleaning or grooming can be done in difficult to reach areas, due to small radiuses of the hull/structures, crevices or intricate constructions present underwater. The focused acoustic pressure shock wave technology due to its ability to get to very difficult to reach areas of intricate structure, can also eliminate biofilms and fouling build-up from propellers, rudders, net ports for cooling of nuclear submarines, outlet ports, sonar housings, protective grills, etc., without affecting their structural integrity.

The cleaning or grooming methods of the present invention that mainly use acoustic pressure shock waves that are non-abrasive, non-contacting, and have the capability to adjust the applied acoustic pressure shock wave energy to the specific cleaning or grooming surface, which allows different materials (e.g. metals, fiberglass, plastics, wood or cement) with different mechanical properties to be cleaned without causing damage or structural stresses. Furthermore, the targeted area for cleaning or grooming can be hit by the acoustic pressure shock waves at different angles (5 to 90 degrees), which create multidirectional forces (perpendicular and tangential to the surface that requires cleaning or grooming) that allow a better detachment of the fouling microorganisms and biofilms. The non-specificity of acoustic pressure shock waves to the material of the hull or underwater structures and to the environment that produces different types of biofilms/fouling represents a great advantage when compared with existing methods that are in general specific to the respective material that is cleaned or type of fouling microorganisms.

The present invention allows the water vessel or potentially any subsurface structure to be cleaned dockside or out to sea or lake or river and relies on the support of a remotely operated "underwater" vehicle (ROV). These ROVs are commercially fabricated for various purposes including underwater applications and require extensive technical expertise to support their unique capabilities, which is not in the scope of this invention. This invention requires that such a remotely operated "underwater" vehicle (ROV) be the carrier for the inspection and cleaning or grooming apparatuses that use acoustic pressure shock waves described herein, so as to enable remotely navigating underwater alongside a vessel or structure, and holding position underwater for inspection and cleaning or grooming. The present invention by utilizing a remotely operated "underwater" vehicle (ROV) is alleviating the need to use divers and thus the danger to human life, it is more effective and in general not damaging to antifouling paints or coatings, since the cleaning or grooming methods utilized are non-abrasive and non-contacting.

To perform a thorough inspection and effective cleaning or grooming of fouling from ships' hull and underwater structures, the present invention utilizes remotely operated cameras and fluorimeters installed on ROVs. The cameras and fluorimeters can be directed via remote control to a specific field of view towards the working surface. The existing technology of fluorimeters enables the cleaning or grooming operator or an expert system to detect biofilms that have adhered to the structure of the ship/underwater structures, which are promoting the growth of algae, barnacles, mollusks, etc., and therefore can distinguishing a clean surface from an unclean marine or aquatic fouled surface. The use of cameras and fluorimeters is also very important to determine where the cleaning or grooming was already done and where it needs to continue, especially for cleaning or grooming processes that must be done with interruptions on multiple days. The field of view can be optimized by the operators ability to set the direction of each camera, and in the event of murky water, which can hamper visibility and fluorimeter sensing, this invention provides a method to seal off the working area, so that clean/clear water can replace the murky water that exists in the working environment. To accomplish this, the present invention identifies the use of an inflatable bladder that will seal the space between the cleaning or grooming apparatus and the working surface. Once the bladder is inflated, the majority of the water that is trapped is pumped out of the working environment and replaced with clean/clear water. Replacing the water in the working environment also enhances the cleaning or grooming inspection process as it progresses, since debris generated during cleaning or grooming process need to be removed to improve the visibility of the working area.

The above water remote operators station for the present invention is capable of controlling the ROV to navigate alongside a structure or vessel's waterline and below for inspection and cleaning or grooming. The remote operator's station provides CCTV (closed circuit television) displays of the environment surrounding the ROV and the viewing of the working area to be cleaned, including the output of fluorometric sensors for detecting biofilms. The remote operators via their remote workstations have the ability to control all aspects of the inspection and cleaning or grooming processes.

In addition to cameras, the present invention in embodiments incorporates sonar transceivers on the ROV and the cleaning or grooming apparatuses to prevent collision and therefore to prevent damage to the ship, ROV, or cleaning or grooming apparatuses. To prevent collision, the present invention will override the controls of the operator if a collision is eminent.

Another embodiment of this invention uses high pressure water jet(s) that augment the cleaning or grooming provided by the acoustic pressure shock waves. The pressurized water would be applied before or after application of the acoustic pressure shock waves to facilitate the best effect on the surfaces being cleaned. The amount of pressure applied by the water jets is adjustable so that it will not remove the protective paint or coatings on the structure's surface. The combination of the two cleaning or grooming methods (water jet technology and shock wave technology) provides a thorough cleaning or grooming system that removes not only the visible fouling debris such as barnacles, mussels, algae, etc., but also removes the microorganisms that have formed biofilms on the surface of water vessels and structures occurring in an underwater environment.

The present invention enables remote control of all the cleaning or grooming apparatuses such that the individual acoustic pressure shock wave generating devices and water jet sources can be made independently active or inactive, and can be directed/oriented to provide a focused area of cleaning or grooming on a fouled subsurface structure, in order to facilitate the removal of organism growth and marine or aquatic biofilms.

DETAILED DESCRIPTION OF THE INVENTION

Embodiments of the invention will be described with reference to the accompanying figures, wherein like numbers represent like elements throughout. Further, it is to be understood that the phraseology and terminology used herein is for the purpose of description and should not be regarded as limiting. The use of "including", "comprising", or "having" and variations thereof herein is meant to encompass the items listed thereafter and equivalents thereof as well as additional items. The terms "connected", and "coupled" are used broadly and encompass both direct and indirect mounting, connecting and coupling. Further, "connected" and "coupled" are not restricted to physical or mechanical connections or couplings.

The inventions summarized below and defined by the enumerated claims are better understood by referring to the following detailed description, which should be read in conjunction with the accompanying figure. The detailed description of the particular embodiment, is set out to enable one to practice the invention, it is not intended to limit the enumerated claims, but to serve as a particular example thereof.

Also, the list of embodiments presented in this patent is not an exhaustive one and for those skilled in the art, new embodiments can be realized.

Figure 1:
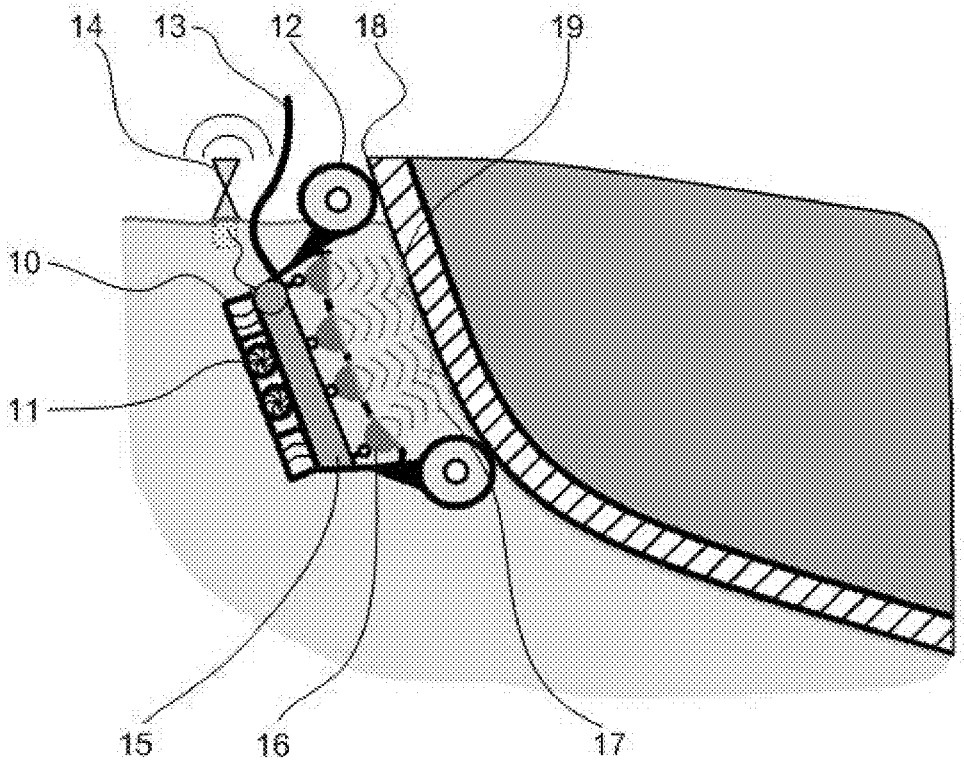
FIG. 1 is a schematic representation of a remotely operated underwater vehicle (ROV) equipped with a cleaning or grooming apparatus that is generating acoustic pressure shock waves toward the water vessel's hull and having thrusters and wheels to transition across the subsurface features of a water vessel according to one embodiment of the present invention.

It is an objective of the present inventions to disclose different embodiments of inspection and cleaning or grooming modules 15 for the inspection and removal of (salt water or fresh water) fouling organism layers 19 from underwater structures such as in FIG. 1 depicting the cleaning or grooming of a water vessel hull, which includes the inspection and removal of the biofilm layer (grooming) that supports the organism growth (cleaning module will remove both organisms and biofilm). The inspection and cleaning or grooming module 15 is supported by an underwater carrier such as a remotely operated (underwater) vehicle 10 (ROV). The ROV 10 is self-propelled, having thrusters 11 and wheels 12 (magnetic or non-magnetic) to navigate along a water vessel surface 18 as in FIG. 1, and controlled from an on-board expert software system or remote controlled using wireless communication with an above water surface control station via floating surface radio antenna 14. The present invention does not limit the means by which the ROV can navigate in order to perform inspection and cleaning or grooming. In the example in FIG. 2, the ROV is equipped with thrusters 11 and controlled magnetic attraction 22 to move along a water vessel surface 18.

The inspection and cleaning or grooming module 15 will utilize one or more cleaning or grooming apparatuses to facilitate removal of the subsurface fouling from water vessels and underwater structures. The primary apparatus being an acoustic pressure shock wave generating device 16 (identified in FIG. 1 and FIG. 2) to not only remove the exterior fouling organism layers 19 but also the removal of the internal biofilm (substrate) layer. The secondary apparatus is the use of pressurized water jets 27 identified in FIG. 2. A general construction of the acoustic pressure shock wave generating device 16 shown in FIG. 2 comprises a reflector 24 to focus the acoustic pressure shock waves 17, a coupling membrane 26 to protect the acoustic pressure shock wave generating device 16 from the external environment, and an energy transfer mechanism that will convert electrical energy into mechanical energy, which in the later case is pressure. The pressurized water jets 27 can use direct positive pressure or a "cavitation (negative pressure) jet" technology, such as described in U.S. Pat. No. 7,494,073, to assist with removal of fouling organism layers 19.

Figure 2:
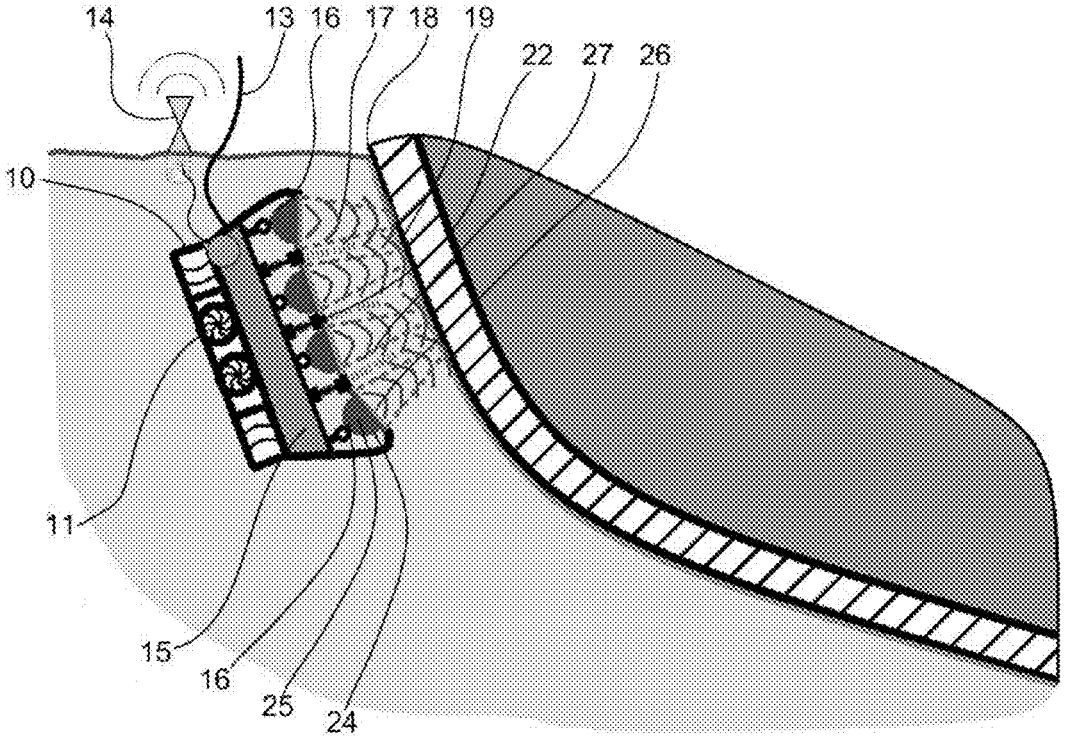
FIG. 2 is a schematic representation of an ROV equipped with a cleaning or grooming apparatus that is generating acoustic pressure shock waves toward the water vessel's hull and using thrusters and controlled magnetic coupling to transition across the subsurface features of a water vessel according to one embodiment of the present invention.

It is an objective of the present inventions to provide acoustic pressure shock wave generating devices 16 (as in FIG. 1 and FIG. 2) (for generating focused acoustic pressure shock waves 17) that are modular, do not need high maintenance, and can be applied/used in conjunction or separately with the high pressure water jets 27 (see FIG. 2).

It is a further objective of the present inventions to provide different energy transfer mechanisms for generating focused acoustic pressure shock waves 17 (as in FIG. 1 and FIG. 2) for the removal of marine (salt water) or aquatic (fresh water) fouling organism layers 19 (including the biofilm) that are attached to the underwater surfaces of water vessels or structures (cleaning). The energy transfer mechanisms/principle of operation for generating acoustic pressure shock waves 17 can comprise any of the following means:

electrohydraulic generators using high voltage discharges electrohydraulic generators using one or multiple laser sources piezoelectric generators using piezoelectric crystals piezoelectric generators using piezoelectric fibers electromagnetic generators using a flat coil electromagnetic generators using a cylindrical coil It is a further objective of the present inventions to provide a means of controlling the accumulative energy at the cleaning or grooming surface of the water vessel or other underwater structures. Controlling the accumulative energy translates to the benefit of the acoustic pressure shock waves to remove the thick fouling organism layers 19 (FIG. 1 and FIG. 2) occurring on water vessels and other underwater structures without the risk of imparting material stress to the water vessel or structure, or the risk of damage to the layers of paint or coatings that exist on the water vessel or structure. If paint or coating layers are detached as part of the cleaning or grooming process they can introduce potential toxins into the water environment. The accumulative energy is the combination of energy (or energy flux density) delivered by one shock wave pulse generated acoustic pressure shock wave generating devices 16, the total number of the acoustic pressure shock waves/pulses delivered to the targeted area, repetition frequency of the acoustic pressure shock waves and special construction of the reflector 24 (refer to FIG. 2) used in the acoustic pressure shock wave generating device 16.

It is a further objective of the present inventions to provide a variety of novel acoustic pressure shock wave generating device 16 (as in FIG. 1 and FIG. 2) constructions and assemblies for the wide area or small area removal of fouling organisms 19 including the biofilm from water vessels and other subsurface structures (cleaning process) or only for the removal of the biofilm (grooming process). The potential size of the cleaning or grooming target area is determined by the number of acoustic pressure shock wave reflectors 24 (refer to FIG. 2) contained in the inspection and cleaning or grooming module 15, the shape/geometry of specific reflector 24, the energy created within the reflector 24, and the capability of the reflector 24 to direct or focus the acoustic pressure shock waves 17 on a specific target.

Figure 3:
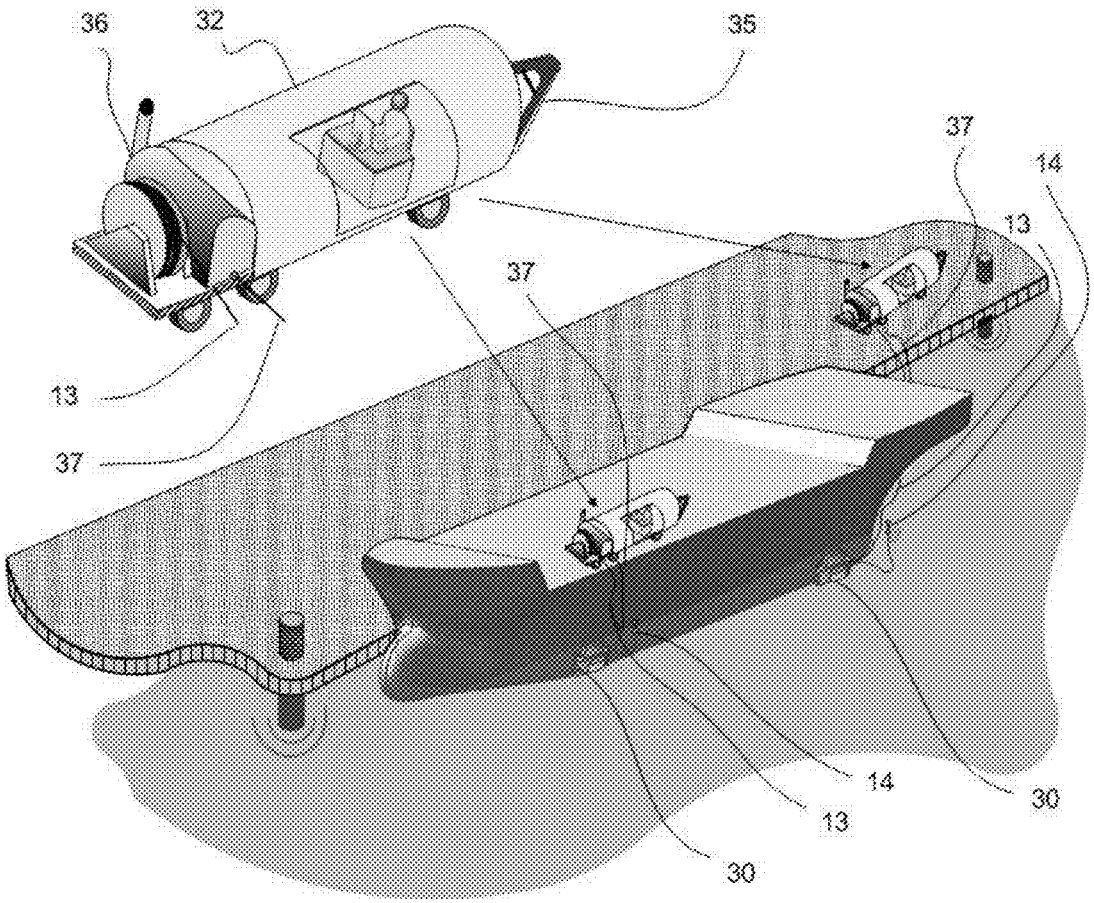
FIG. 3 is a schematic representation of an inspection and cleaning or grooming system including the operators station and of an ROV according to one embodiment of the present invention.

The present invention pictorialized in FIG. 3 performs the inspection and cleaning or grooming of water vessels and underwater structures with the use of a remotely operated inspection and cleaning or grooming vehicle 30 (the integration of the ROV with the inspection and cleaning or grooming module 15) to perform the underwater navigation, inspection, and the control of cleaning or grooming process. The level of operating autonomously in navigating and for inspection or cleaning or grooming can vary depending on the level of software intelligence developed for the ROV and for the inspection and cleaning or grooming module 15. In the embodiment of FIG. 3, the inspection and cleaning or grooming vehicle 30 is expected to perform some level of remote communications with the operator's station 32 using either wireless communication via floating surface radio antenna 14, or wired communication through a system hybrid cable 13 connected between the operator's station 32 and the inspection and cleaning or grooming vehicle 30. The remote operator's station 32 in FIG. 3 is on a trailer 35 so that it is portable and can be located dockside or on-board of the ship so inspection and cleaning or grooming can be performed dockside or out to sea, respectively. The remote operator's station 32 provides the power sources for the entire inspection and cleaning or grooming system using various on-board generators 36 to create the electrical power, filtered pressurized water, and an underwater vacuum source. The generator for the pressurized water extracts and filters the local sea water from a siphoning hose 37. Remotely operating the inspection and cleaning or grooming vehicles 30 simplifies the coordination of having multiple such vehicles performing the inspection and cleaning or grooming of a large water vessel or large underwater structure and reduces the chances of tangling cables between vehicles.

In FIG. 3 there is a system hybrid cable 13 that the operator's station 32 supplies to the remote cleaning or grooming vehicle 30, which can comprise, but not limited to, supplying power, an optical fiber, a high pressure water hose, and a vacuum hose. The optical fiber can be used as an optional wideband communication link, or used strictly to send the video images from underwater cameras located on the inspection and cleaning or grooming vehicle 30. The high pressure water hose will supply pressurized water jet 27 (see FIG. 2) to the inspection and cleaning or grooming vehicle 30 for various purposes to be described later. The vacuum hose will enable the inspection and cleaning or grooming vehicle 30 to transfer the removed fouling material to the operator's station 32 for processing.

Figure 4A:
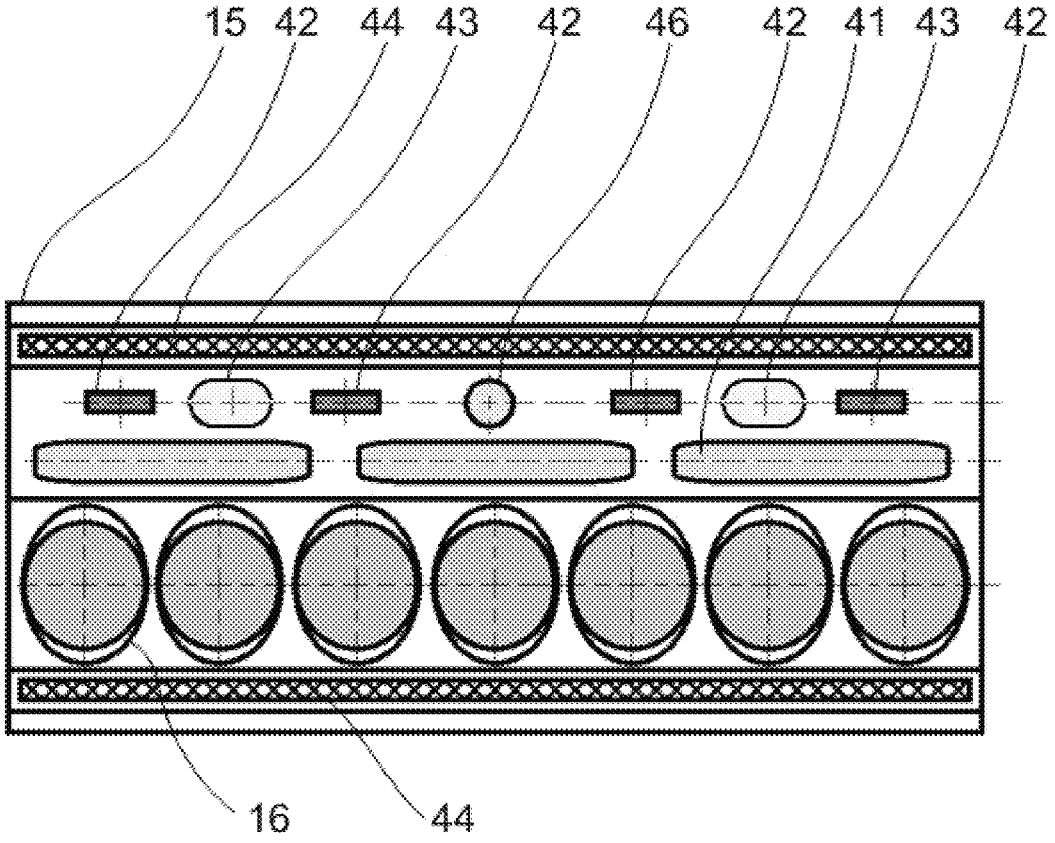
FIG. 4A is a front view schematic representation of an inspection and cleaning or grooming module containing multiple cleaning or grooming apparatuses and sensors according to one embodiment of the present invention.

The embodiment of FIG. 1 and FIG. 2 shows the use of acoustic pressure shock waves 17 to remove the fouling organism layers 19, which includes the biofilm (not specifically shown in the figure as a distinct feature), from a water vessel surface or underwater structure surface 18. The acoustic pressure shock waves 17 are generated from the inspection and cleaning or grooming module 15 that is attached to a remotely operated "underwater" vehicle (ROV) 10. An embodiment of an inspection and cleaning or grooming module 15 is shown in FIG. 4A that would be carried by the ROV 10, as shown in FIG. 1 or FIG. 2, to a position along the water vessel surface or underwater structure surface 18 for inspection and cleaning or grooming. The navigation and inspection features of the inspection and cleaning or grooming module 15 embodiment of FIG. 4A provides an array of light emitting diodes 44 for underwater illumination, four closed circuit cameras 42 for underwater inspection, a fluorometric sensor 46 for detecting biofilm, and two ultrasonic sonar sensors 43 to measure distance to the underwater structure. The cleaning or grooming apparatuses of FIG. 4A comprises seven acoustic pressure shock wave generating devices 16 and three high pressure water jet nozzles 41. The acoustic pressure shock wave generating device 16 receives its power from the power and control system 40 (see FIG. 4B), whereas the pressurized water is supplied externally from a remote operator's station 32 (as in FIG. 3). The particular number of functional features just described is an example for the embodiment in FIG. 4A and the number of features can be scaled appropriately for the type or size of structure features being cleaned. For example vacuum intakes can be added to the inspection and cleaning or grooming module 15 (not shown in FIG. 4A) for the case when the removal of fouling material is necessary via a vacuum hose that will enable the inspection and cleaning or grooming vehicle 30 to transfer to the operator's station 32 the mixture of water and fouling material for processing/cleaning/filtration.

Figure 4B:
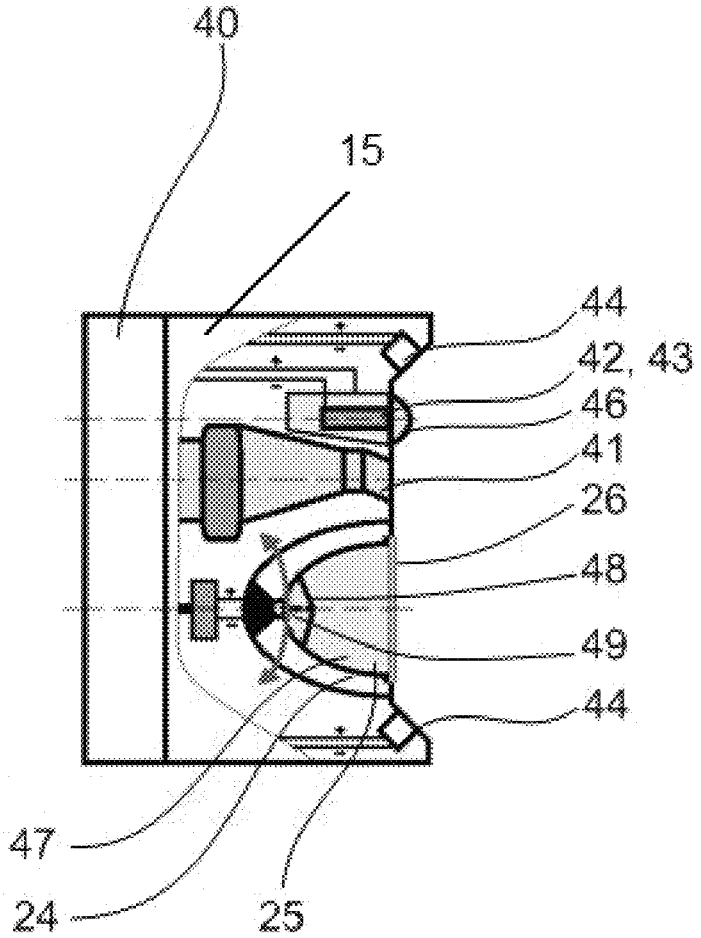
FIG. 4B is a cross-sectional side view schematic representation of the module of FIG. 4A according to one embodiment of the present invention.

As presented in FIG. 4B, the acoustic pressure shock wave generating devices 16 from FIG. 4A can have their acoustic pressure shock wave reflectors 24 able to tilt their angle (see arrows from FIG. 4B) in both X and Y planes with respect to the inspection and cleaning or grooming module 15 position so that it can optimally direct its focal energy towards the cleaning or grooming target. The ability to tilt to a specific angle can be controlled locally by the power and control system 40 contained within the inspection and cleaning or grooming module 15, or controlled remotely by a remote operator's station 32 (as in FIG. 3) communicating with the inspection and cleaning or grooming module 15.

The high pressure water jet nozzles 41 from FIG. 4A can be directed toward the same cleaning or grooming target as the acoustic pressure shock wave reflector 24 by controlling the pitch of the water jet nozzle 41 shown in FIG. 4B. The ability to control the pitch of the water jet nozzle 41 can be done locally by the power and control system 40 contained within the inspection and cleaning or grooming module 15, or controlled remotely by a remote operator's station 32 (as in FIG. 3) communicating with the inspection and cleaning or grooming module 15. The combination of the directed water jet nozzles 41 and the directed acoustic pressure shock wave reflectors 24 toward the same cleaning or grooming target would reduce the overall cleaning or grooming time and would also increase the efficacy of the cleaning or grooming process.

Each acoustic pressure shock wave generating device 16 in FIG. 4A has an acoustic pressure shock wave reflector 24 and a coupling membrane 26 both shown in FIG. 4B. The energy source for the acoustic pressure shock wave generating device 16 from FIG. 4B is provided in the form of high voltage generated by the power and control system 40 and applied across an anode tip 49 and cathode tip 48 that are immersed in the reflector liquid 47. The reflector liquid 47 is contained by the reflector cavity 25 and the coupling membrane 26. A high voltage applied between the tips results in an electrical current flowing between the anode tip 49 and cathode tip 48. The electrical current increases at an extremely fast rate, in the tens of nanoseconds, while at the same time superheating the reflector liquid 47 in between the tips to create a plasma bubble in the reflector liquid 47. The formation of a plasma bubble in between the anode tip 49 and cathode tip 48 occurs at a rate in the tens of nanoseconds, similar to the increasing rate of change of the electrical current. The rise in electrical current that creates the fast growing plasma bubble generates the primary shock wave front, which together with reflected shock waves on the acoustic pressure shock wave reflector 24 produces the positive pressure component of the acoustic pressure shock waves 17 (see FIG. 1). Once the potential voltage between the tips is no longer supplied or sufficient to support the flow of electrical current, the pressure of the reflector liquid 47 surrounding the plasma bubble will be higher than the plasma bubble's internal pressure. It is this transition that will cause the plasma bubble to rapidly collapse creating the negative (cavitation) pressure component of the acoustic pressure shock wave 17, known also as the tensile component of the acoustic pressure shock wave 17. The magnitude of voltage applied in between the anode tip 49 and cathode tip 48 can be controlled locally by the power and control system 40 contained within the inspection and cleaning or grooming module 15, or controlled remotely by a remote operator's station 32 (as in FIG. 3) communicating with the inspection and cleaning or grooming module 15.

Figure 5:
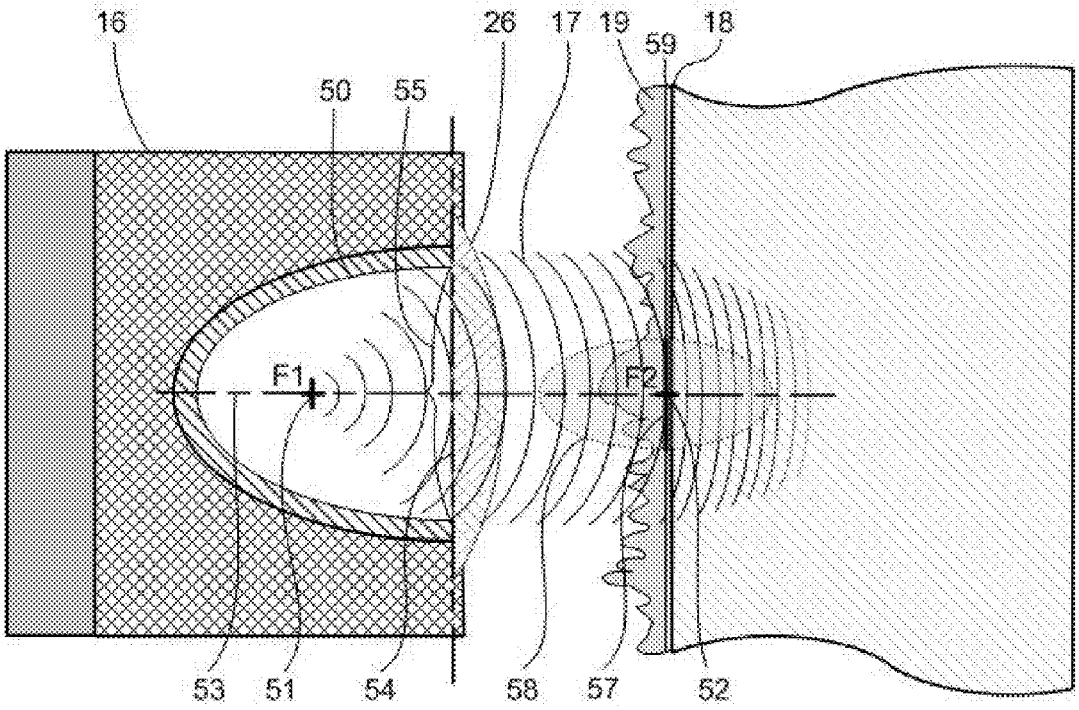
FIG. 5 is a schematic representation of the interaction of focused acoustic pressure shock waves with an underwater surface when an ellipsoid reflector is used as one embodiment of the acoustic pressure shock wave generator of the invention.

One embodiment of the acoustic pressure shock wave reflector 24 described by FIG. 4B is a partial ellipsoidal reflector 50 diagramed in FIG. 5. The acoustic pressure shock waves 17 produced at the first focal point $F_1$, as diagramed in FIG. 5, are reflected and focused by the partial ellipsoidal reflector 50 towards the second focal point $F_2$ 52 of the partial ellipsoid reflector 50. It is the combination of partial ellipsoidal reflector 50 design, together with the applied energy in first focal point $F_1$ 51 that will dictate the distance where the second focal point $F_2$ 52 is found. The placement of the acoustic pressure shock wave generating device 16 relatively to the cleaning or grooming target will also dictate where the second focal point $F_2$ 52 is found in the targeted area. Due to the fact that different pressures fronts (direct or reflected) reach the second focal point $F_2$ 52 with certain small time differences, the acoustic pressure shock waves 17 are in reality concentrated or focused on a three-dimensional space around second focal point $F_2$ 52 which is called focal volume 58. Inside the focal volume 58 are found the highest pressure values for each acoustic pressure shock wave 17, which means that is preferable to position the targeted area 57 for cleaning or grooming so that it intersects the focal volume 58 and if possible it is centered on the second focal point $F_2$ 52. This positioning will allow the highest efficiency in cleaning or grooming the targeted area 57 using the acoustic pressure shock wave generating devices 16. An ultrasonic sonar sensor 43 (as described in FIG. 4A) would provide the position information to set the cleaning or grooming target distance at the focal point $F_2$ 52 and maintaining the targeted area 57 intersecting the focal volume 58 at all times.

The ability of acoustic pressure shock waves 17 (shown in FIG. 5) to destroy biofilms (grooming process) is a significant benefit for it eliminates the possibility of growth of marine (salt water) or aquatic (fresh water) organisms that would result in fouling that requires a cleaning process (more laborious and intensive compared to grooming process). In order to be effective, the acoustic pressure shock wave generating device 16 and its components are designed in such way to ensure that the focal volume 58 (where acoustic pressure shock waves 17 are focused) is positioned deep enough to allow its overlap with the fouling organism layers 19 and the water vessel's or underwater structure's surface 18, where the biofilm layer 59 is present as shown in FIG. 5. The acoustic pressure shock wave 17 penetration through to the biofilm layer 59 and the geometry of the focal volume 58 are dictated by the energy generated at focal point $F_1$ 51, and the dimensional characteristics of the ellipsoidal reflector 50 (the ratio of the large semi-axis 53 and small semi-axis 54 of the ellipsoid and its aperture 55 defined as the dimension of the opening of the ellipsoidal reflector 50). Thus the ellipsoidal reflector 50 needs to be deep enough to allow the second focal point $F_2$ 52 to be positioned within the deepest fouling organism layers 19 of the structure down to the water vessel surface or underwater structure surface 18 of the structure without any physical contact of the acoustic pressure shock wave generating device 16 with the surface 18 of the structure (avoids any scrapping or other mechanical damage to the water vessel surface or underwater structure surface 18 or to the inspection and cleaning or grooming vehicle 30 (see FIG. 3). The deep ellipsoidal reflector 50 is also advantageous due to the fact that the larger the focusing area of the ellipsoidal reflector 50, the larger the focal volume will be and the energy associated with it, which is deposited into the targeted area. In general to accomplish that, the ratio of the large semi-axis 53 and small semi-axis 54 of the ellipsoidal reflector 50 should have values larger than 1.6 (the dimension of the small axis of the ellipsoid 54 and the large axis of the ellipsoid 53 identified in FIG. 5 is given by their intersection with the ellipsoid and with semi-axis value being defined as half of their respective full dimensions).

Figure 6:
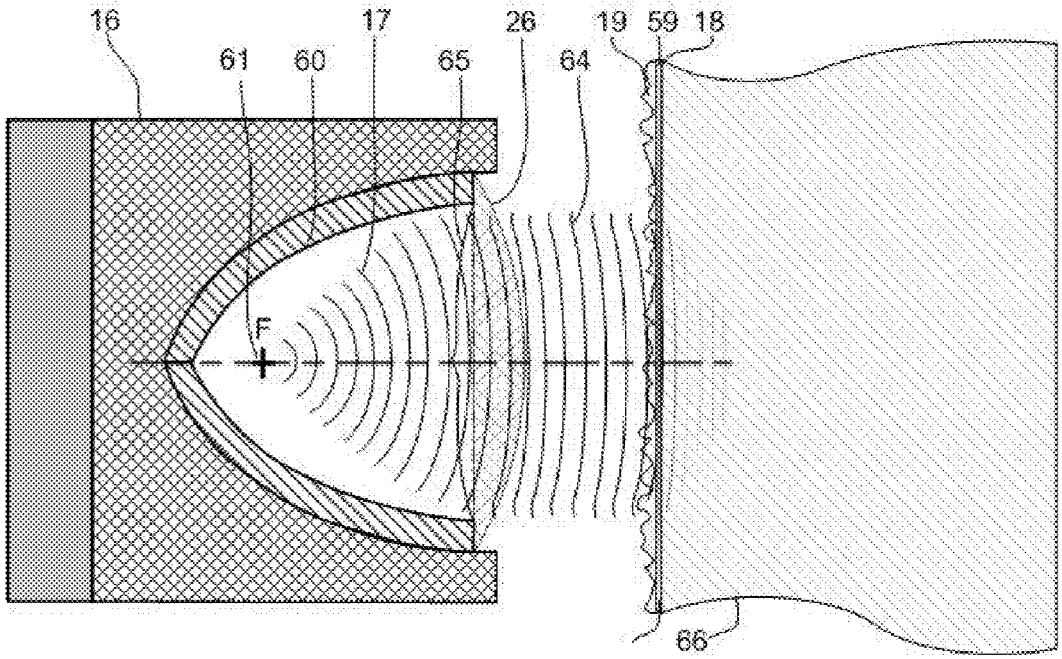
FIG. 6 is a schematic representation of the planar acoustic pressure shock waves that emanate from a parabolic reflector as one embodiment of the acoustic pressure shock wave generator of the invention.

In the embodiment from FIG. 6 the acoustic pressure shock wave generating device uses a parabolic reflector 60 that sends pseudo-planar acoustic pressure shock waves 17 outside the coupling membrane 26 and inside the targeted fouling organism layers 19 attached to the water vessel's or underwater structure's surface 18. The parabolic reflector 60 has only a central point F where radial acoustic pressure shock waves 17 are generated (from an energy source). The radial acoustic pressure shock waves 17 propagate and reflect on the parabolic reflector 60 at different time points, which creates secondary wave fronts (not shown on FIG. 6 to keep clarity), especially at the edge/aperture 65 of the parabolic reflector 60. The combination of direct radial acoustic pressure shock waves 17 with the secondary wave fronts creates pseudo-planar acoustic pressure shock waves 64 outside the coupling membrane 26. By their nature, the pseudo-planar acoustic pressure shock waves 64 (exiting through the aperture 65 of the parabolic reflector 60) are unfocused and thus they move inside the fouling organism layers 19 away from their point of origin F without being able to be concentrated/focused in a certain focal region, as seen before in FIG. 5 for the acoustic pressure shock waves 17 that are focused. The pseudo-planar acoustic pressure shock waves 64 deposit their energy into the fouling organism layers 19 including the biofilm 59, until all of their energy is consumed. In other words, the pseudo-planar acoustic pressure shock waves 64 have their maximum energy superficially at the interface of the underwater structure 66 and the biofilm layer 59 that forms on the underwater structure surface 18, and become weaker as they travel further inside the underwater structure 66 away from the underwater structure surface 18. This means that it may preferable to use this embodiment presented in FIG. 6 to clean surfaces that are structurally weak and do not have deep fouling organism layers 19. The advantage of this embodiment presented in FIG. 6 is that in one position of the inspection and cleaning or grooming vehicle 30 a larger area is groomed or cleaned by pseudo-planar acoustic pressure shock waves 64 when compared to the focused acoustic pressure shock waves 17 where the groomed or cleaned area in one position is given mainly by the dimensions of the focal volume 58 (see FIG. 5). The pseudo-planar acoustic pressure shock wave 64 penetration depths are controlled by the input energy applied to the origin F.

The quantity of acoustic pressure shock wave energy deposited into the fouling organism layers 19 in one cleaning or grooming session is dependent on the dosage, which comprises the following characteristics.

Figure 7A:
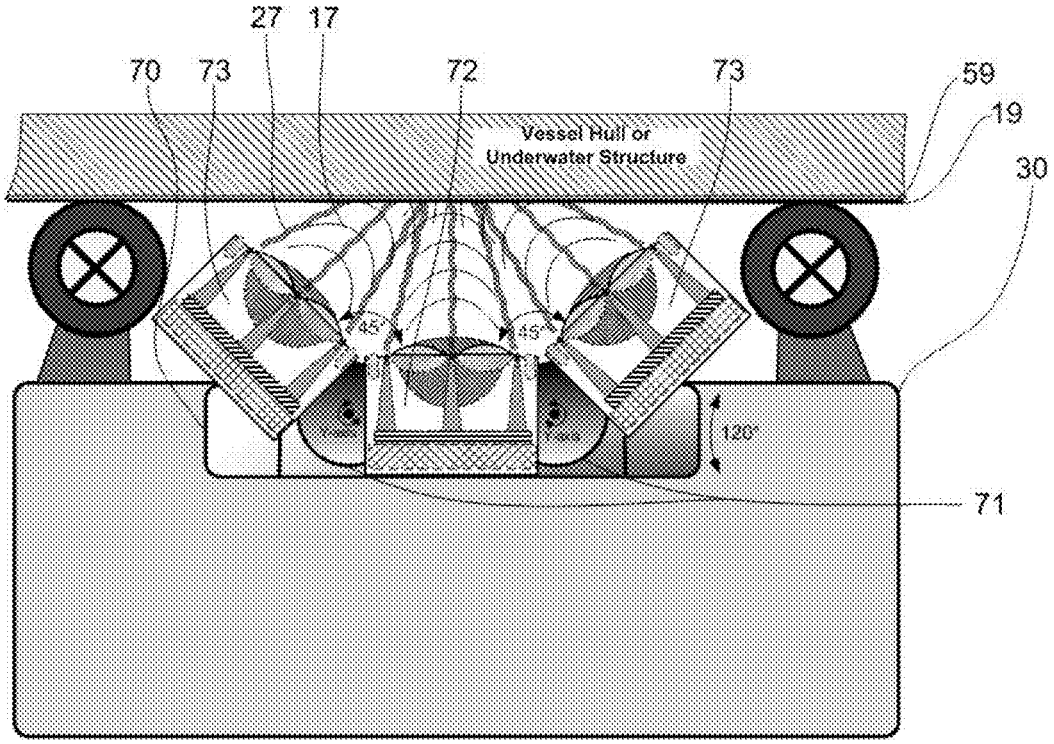
FIG. 7A is a cross-sectional top view schematic representation of a ROV that is generating both acoustic pressure shock waves and pressurized water jets at the subsurface features of a water vessel or other underwater structure according to one embodiment of the present invention.
Figure 7B:
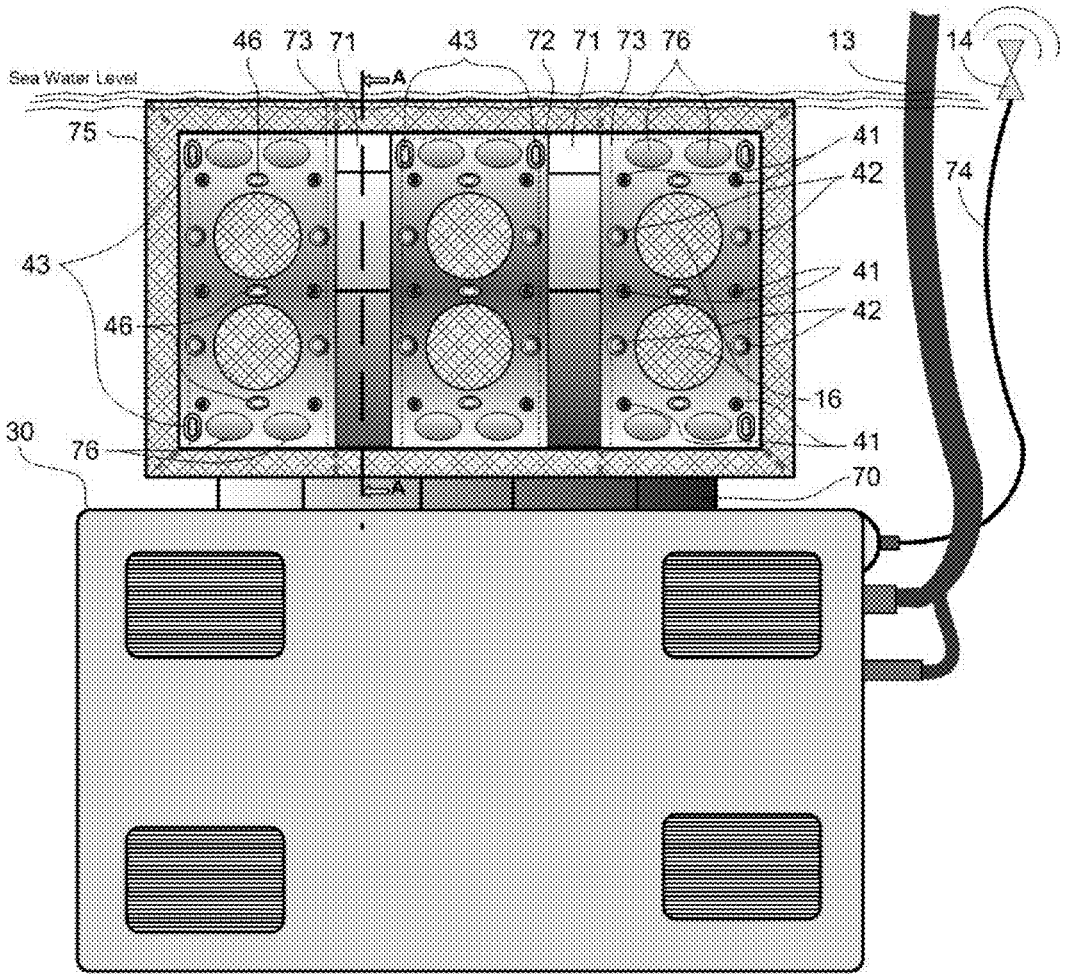
FIG. 7B is a schematic representation of the ROV of FIG. 7A, illustrating the functional features of the different cleaning or grooming and inspection modules according to one embodiment of the present invention.
Figure 7C:
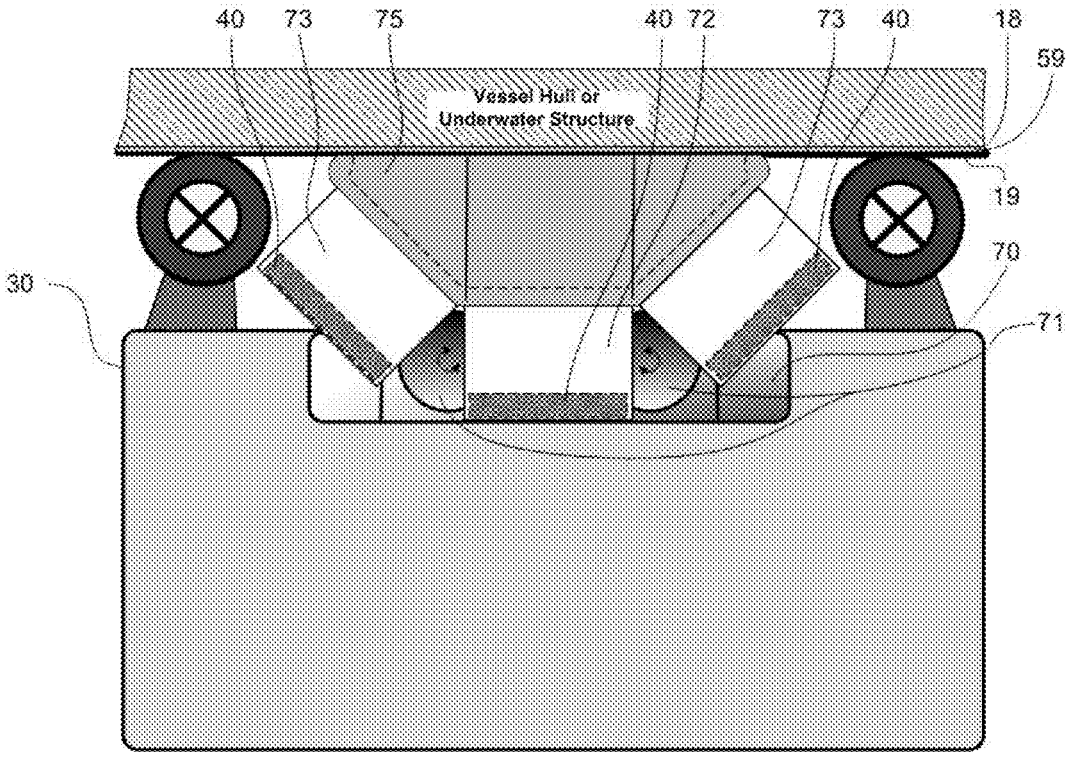
FIG. 7C is a schematic representation showing an inflated bladder positioned between the cleaning or grooming modules of the ROV of FIG. 7A and the ship's hull according to one embodiment of the present invention.
Figure 7D:
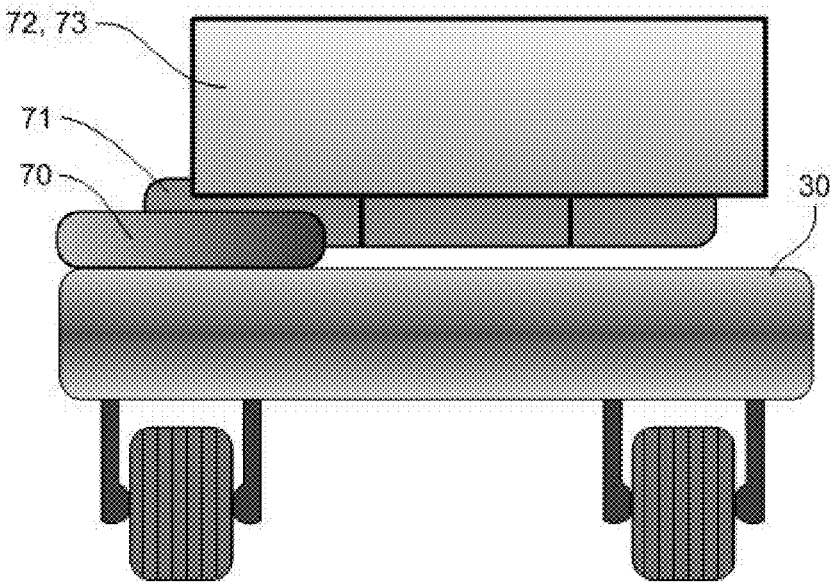
FIG. 7D is a schematic representation of the ROV of FIG. 7A with the cleaning or grooming and inspection modules folded down for transport in according to one embodiment of the present invention.

Input energy delivered to the focal point $F_1$ 51 shown in FIG. 5, and the central point F 61 shown in FIG. 6, which is:

a. for electrohydraulic shock wave generating devices it is the voltage applied to the electrodes as described for FIG. 4B and FIG. 7B
b. for piezoelectric shock wave generating devices it is the voltage applied to the piezoelectric fibers or piezoelectric crystal structures, as described in detail for FIG. 7C
c. for electromagnetic generators it is the voltage applied to the electromagnetic coil, as described in detail for FIG. 7D
d. for laser generated energy it is the optical energy delivered to the focal point $F_1$ and central point F, as described in detail for FIG. 7B Output energy of each acoustic pressure shock wave in the targeted zone; known as energy flux density [mJ/mm$^2$] or instantaneous intensity [mJ] at a particular impact point in space.

Frequency of repetition for acoustic pressure shock waves, defined as number of acoustic pressure shock waves per each second.

Total number of acoustic pressure shock waves delivered in one cleaning or grooming session.

Cavitation plays a primary role in the destruction of the biofilm layer 59 (see FIG. 5). In order to have maximum potential for the cavitation phase of the acoustic pressure shock waves 17, the repetition rate or frequency of acoustic pressure shock waves 17 is recommended to be in the range of 4 to 8 Hz so as to not be negatively influenced by the subsequent inbound acoustic pressure wave 17. The maximum frequency is to be limited so that the cavitation bubbles have sufficient time to grow to their maximum dimension and then collapse with velocities of more than 100 m/s, which will allow the maximum effects to be seen on the biofilm layer 59 (grooming process) or on the fouling organism layers 19 plus the biofilm layer 59 (cleaning process).

FIG. 7A is the embodiment of a remote inspection and cleaning or grooming vehicle 30 that is fitted with three inspection and cleaning or grooming modules mounted to a rotating vertical frame 71, which itself is mounted to a supporting base/rotating base 70. The rotating vertical frame 71 can rotate the outer two inspection and cleaning or grooming modules 73 from 0 to a 45 degree angle relative to the center inspection and cleaning or grooming module 72, and all three modules can rotate through an angle of 120 degrees relative to the a supporting base/rotating base 70. The ability to rotate the angle of the inspection and cleaning or grooming modules (72 and 73) in two directions allows this embodiment to inspect and clean different surface angles of the water vessel or underwater structure, and while covering a wider area or a smaller focused area. This rotation ability also can place the inspection and cleaning or grooming modules (72 and 73) into a transport position so they lay flat with the bed of the remote inspection and cleaning or grooming vehicle 30 (shown in FIG. 7D).

FIG. 7B is a front view of the embodiment in FIG. 7A illustrating that each inspection and cleaning or grooming module 72 and 73 contains four flood lights 76 to illuminate underwater, two ultrasonic sonar sensors 43 to detect distance to the cleaning or grooming target, four closed-circuit cameras 42 provide a panoramic view of the water vessel or underwater structure, and three fluorometric sensors 46 for detecting biofilms, all to support inspection. The actual cleaning or grooming process is performed by the inspection and cleaning or grooming module 72 and 73 consists of comprising two acoustic pressure shock wave generating devices 16 and six high pressure water jet nozzles 41. The remote inspection and cleaning or grooming vehicle 30 provides a retractable cable 74 connection to a floating surface radio antenna 14 (shown also in FIG. 1. FIG. 2 and FIG. 3) for wireless communication with a remote operator's station 32 (shown in FIG. 3). The remote inspection and cleaning or grooming vehicle 30 provides a system hybrid cable 13 connection that will supply high pressure water for the water jet nozzles 41 used in cleaning or grooming and in filling an inflatable bladder 75, and a vacuum hose connection to transfer murky water or the removed fouling material from the cleaning or grooming environment to a topside processing station. Additionally, the system hybrid cable 13 connections provide electrical power for all of the inspection and cleaning or grooming modules 72 and 73, and an optical fiber connection for transmission of optical images and/or wired communication from each of the inspection and cleaning or grooming modules 72 and 73 to the remote operator's station 32 (shown in FIG. 3).

The inspection and cleaning or grooming modules 72 and 73 of FIG. 7B refer to an inflatable bladder 75 that is shown inflated in FIG. 7C. When inflated the inflatable bladder 75 extends from the inspection and cleaning or grooming modules 72 and 73 towards the water vessel or underwater structure surface 18 to provide a partial seal (partial because of the uneven topology of the organism fouling layers 19). This way murky water or fouling debris contained in within the (salt or fresh) water environment can be pumped out and replaced with clear water. Providing clear water in the inspection environment improves the ability to observe with the underwater closed-circuit cameras 42 (shown in FIG. 7B) or fluorometric sensors 46 (shown in FIG. 7B) to detect biofilm 59. The inflatable bladder 75 also provides a means to collect the fouling debris as it is being removed and transferred topside for proper disposal. The inflatable bladder 75 is partitioned within and between the inspection and cleaning or grooming modules 72 and 73 so that each bladder section can be separately pressurized to account for the potentially different spatial volumes the bladder will need to enclose. Each bladder section can be inflated using pressurized air or pressurized (salt or fresh) water under the control of a local power and control system 40 contained within the inspection and cleaning or grooming modules 72 and 73, or controlled remotely by a remote operator's station 32 (shown in FIG. 3) communicating with the inspection and cleaning or grooming modules 72 and 73. The inflatable bladder 75 is made of flexible plastic materials with smooth surface to accomplish a good sealing with the vessel hull or underwater structure surface 18 and also to protect the integrity/no scratching of the vessel hull or underwater structure surface 18.

Figure 8:
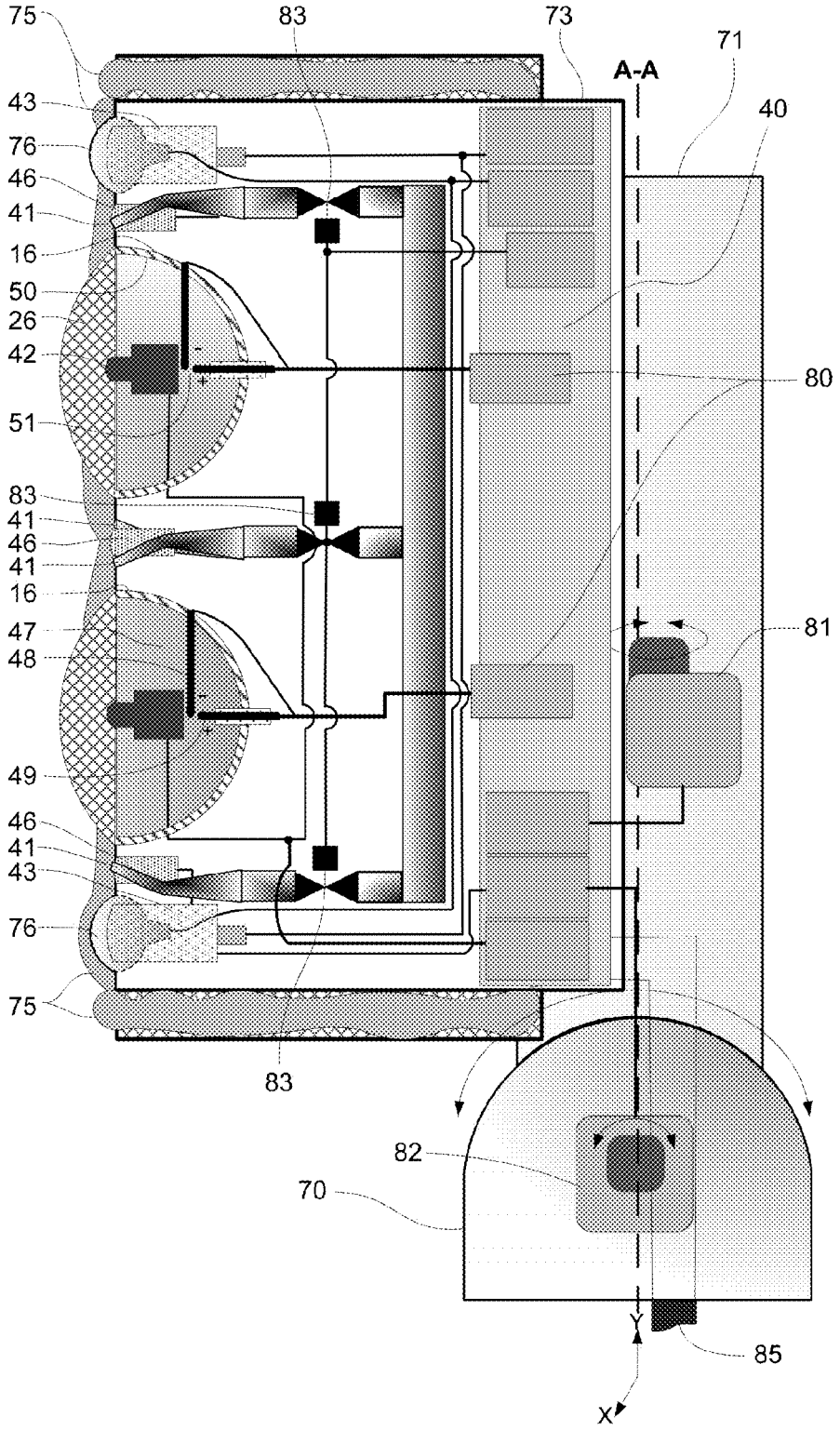
FIG. 8 is a perspective schematic view along the section plane A-A of the cleaning or grooming and inspection module of FIG. 7B that uses high voltage tip discharge to create an acoustic pressure shock wave according to one embodiment of the present invention.

The drawing of FIG. 8 is a cross sectional A-A view of a special embodiment of the outer inspection and cleaning or grooming modules 73 of FIG. 7B. The emphasis for the following description is of the acoustic pressure shock wave generating device 16 that operates identically for all the inspection and cleaning or grooming modules 72 and 73 of FIG. 7B. The outer inspection and cleaning or grooming module 73 is being described for it has the unique ability to rotate about the Y-axis as shown in FIG. 7A, whereas the center inspection and cleaning or grooming module 72 (in FIG. 7B) remains fixed about the Y-axis. The two acoustic pressure shock wave generating devices 16 utilize an ellipsoidal reflector 50 and a coupling membrane 26 to contain the reflector liquid 47 that is partially localized superheated with an energy source to create a plasma bubble that during its oscillation produce the focused acoustic pressure shock waves 17 (shown in FIG. 5). The energy source for the acoustic pressure shock waves 17 occurs by applying a high voltage across two electrodes (similar to what was described for FIG. 4B). In FIG. 8 there is an anode tip 49 and a cathode tip 48 (the electrodes) that connect to a switched high voltage supply 80 with the most positive potential connected to the anode tip 49. The power and control system 40 controls the voltage level, the repetition rate, and the duration that the voltage is applied to the electrodes (anode tip 49 and cathode tip 48). Applying the high differential voltage between the electrodes produces an electrical current in the reflector liquid 47 environment flowing from the anode tip 49 to the cathode tip 48. The electrical current is occurring in the geometric focal point $F_1$ 51 (see FIG. 5) of the ellipsoidal reflector 50, and the magnitude of the electrical current increases while the high voltage is applied. As the magnitude of the electrical current increases the reflector liquid 47 in the region of the focal point $F_1$ 51 is superheated to produce a plasma bubble that grows rapidly in size as the electrical current increases in magnitude. The rapid expansion and then collapse (when the high voltage between the electrodes will stop the flow of electrical current between the electrodes) of the plasma bubble produce the acoustic pressure shock waves 17, which are then focused toward the focal volume 58 (see FIG. 5). The embodiments of FIG. 7A and FIG. 7B use six high pressure water jet nozzles 41 to augment the acoustic pressure shock wave generators 16 action on the fouling organism layer 19 and biofilm layer 59 (see FIG. 5). There is an electronic valve 83 associated with each high pressure water jet nozzle 41 to enable individual on/off control. A module hybrid cable 85 integrates a power cable, fiber optic cable, pressurized water tube, and a vacuum tube in one with an external protective jacket to connect to the inspection and cleaning or grooming module 73. The power cable can provide one or more voltages to power the systems in the inspection and cleaning or grooming module 73, however the switched high voltage supply 80 would be best located within the inspection and cleaning or grooming module 73 to reduce power loss due to cable length. The pressurized water tube (from module hybrid cable 85) would be the source of pressurized water to the high pressure water jet nozzles 41 and potentially the source for filling the inflatable bladder 75. Alternatively the inflatable bladder 75 could be filled by pressurized air but that would require another tube be added to the module hybrid cable 85. The vacuum tube is the source for extracting fouling debris contained within the cleaning or grooming environment trapped by the inflatable bladder 75. A similar module hybrid cable 85 would connect to the inspection and cleaning or grooming module 72 (the central module presented in FIG. 7A). This drawing also illustrates the means of rotating the inspection and cleaning or grooming modules 72 and 73 in both and X and Y rotation. The X-motor with gear head 82 rotates all of the inspection and cleaning or grooming modules 72 and 73 through a 120 degree angle about the X-axis (refer to bottom of FIG. 8) by its connection to the rotating base 70, which in turn rotates about the X-axis the vertical frame 71 that each of the inspection and cleaning or grooming modules 72 and 73 are mounted to (refer to FIG. 7A). The Y-motor with gear head 81 rotates the inspection and cleaning or grooming module 73 about the Y-axis from 0 to 45 degrees relative to the center of the inspection and cleaning or grooming module 72 (in FIG. 7B). The combination of the two angular movements allow the system to adapt to the pitch and curvature of a water vessel's hull or other underwater structures for inspection and cleaning or grooming and to also position all of the inspection and cleaning or grooming modules 72 and 73 in a home position for transport as shown in FIG. 7D. On the same FIG. 8 other elements that comprise the cleaning or grooming modules 72 and 73 can be seen as the fluorometric sensors 46, flood lights 76, closed circuit cameras 42 and ultrasonic sonar sensors 43.

Figure 9:
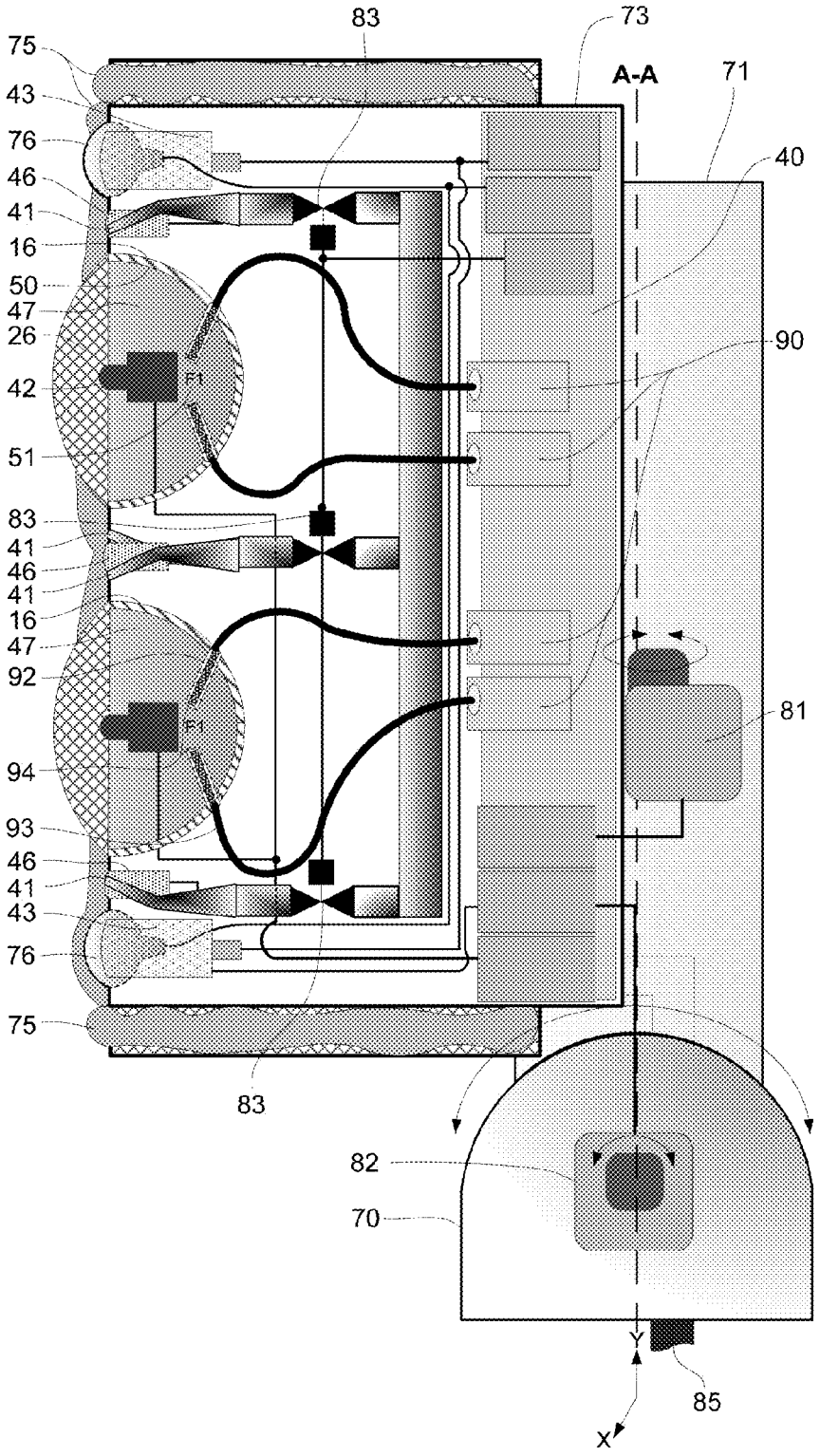
FIG. 9 is a perspective schematic view along the section plane A-A of the cleaning or grooming and inspection module from FIG. 7B that uses high energy laser(s) to create an acoustic pressure shock wave according to one embodiment of the present invention.

The drawing of FIG. 9 is another embodiment of a cross sectional A-A view of an outer inspection and cleaning or grooming module 73 of FIG. 7B. The difference being that the two acoustic pressure shock wave generating devices 16 utilize a different source of energy than FIG. 8 to create acoustic pressure shock waves 17 (see FIG. 5). In the embodiment of FIG. 9 the energy source for the acoustic pressure shock wave 17 occurs from two lasers 90 for each acoustic pressure shock wave generator 16. In other embodiments three or four lasers may be used to generate the acoustic pressure shock waves 17, but for simplicity of the drawing in FIG. 9 an embodiments with two lasers 90 will be presented. The laser 90 output is coupled by the fiber optic cable 93 to the optical feed-through assembly 92. The optical feed-through assembly 92 is used to convey and direct the optical energy from the laser 90 into the reflector liquid 47 at the focal point $F_1$ 51 (see FIG. 5) of the ellipsoidal reflector 50, while protecting the internal elements of the optical feed-through assembly that in part ends with an optical lens or beam collimator 94 to direct the optical energy to the focal point $F_1$ 51. The amplitude, modulation, and duration of the laser output is precisely controlled by the power and control system 40 so that the reflector liquid 47 environment at the focal point $F_1$ 51 is superheated to create a plasma bubble that rapidly expands and collapses transforming the heat into acoustic pressure shock waves that possess both a compressive and tensile force behavior in each wave. Though the embodiment of FIG. 9 shows two laser sources for each acoustic pressure shock wave generator 16, one or more laser sources can be used based on cost versus benefit. Each of the shock wave generating devices 16 in FIG. 9, as in FIG. 8 and FIG. 7B, are augmented by six of the pressurized water jet nozzles 41 to assist in the removal of the marine or aquatic fouling organism layer 19 and biofilm layer 59 (see FIG. 5). All other features and functions of the embodiment in FIG. 9 are identical to those from FIG. 8.

Figure 10:
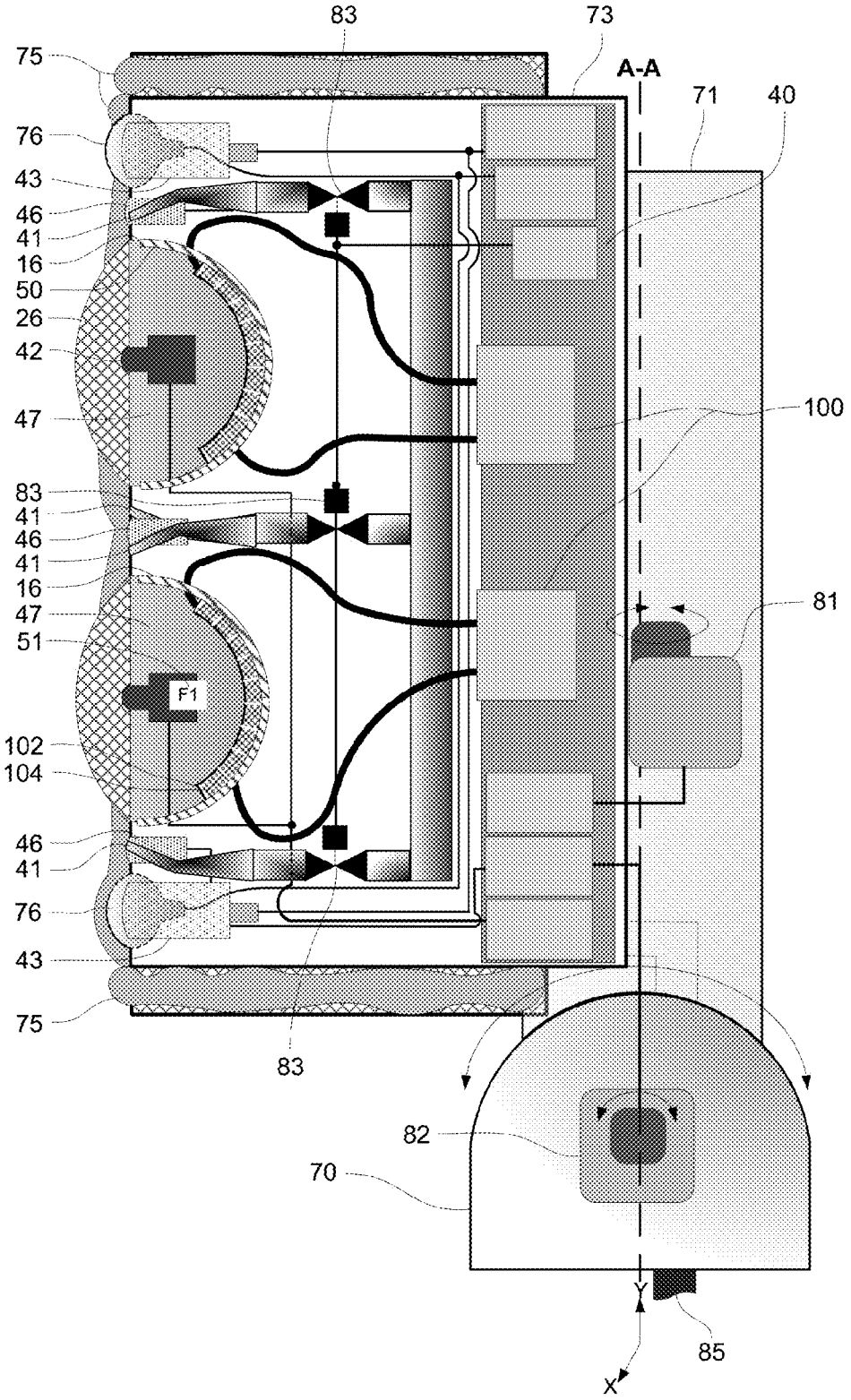
FIG. 10 is a perspective schematic view along the section plane A-A of the cleaning or grooming and inspection module from FIG. 7B that uses a piezoelectric fiber composite structure to create an acoustic pressure shock wave according to one embodiment of the present invention.

The drawing of FIG. 10 is another embodiment of a cross sectional A-A view of an outer inspection and cleaning or grooming module 73 of FIG. 7B. The difference from the previous embodiments is that the two acoustic pressure shock wave generating devices 16 utilize a different source of energy than FIG. 8 and FIG. 9 to create acoustic pressure shock waves 17 (see FIG. 5). In the embodiment of FIG. 10 the energy source for the acoustic pressure shock wave occurs from a piezoelectric crystals or piezoelectric fiber composite structure 102 embodied in each acoustic pressure shock wave generator 16. The piezoelectric crystals or piezoelectric fiber composite structure 102 is a flexible substrate for the individual piezoelectric crystals or piezoelectric fiber groups 104 and provides the power distribution to the individual piezoelectric crystals or piezoelectric fiber groups 104. Power is applied 180 degrees out of phase with adjacent piezoelectric crystals or piezoelectric fiber groups 104 to generate an alternating pressure wave by the flexing of the piezoelectric crystals or piezoelectric fiber composite structure's 102 substrate. Piezoelectric crystals or piezoelectric fiber groups 104 are distributed along the ellipsoidal reflector 50 to align with the focal point ($F_1$) 51 (see also FIG. 5) of the ellipsoidal reflector 50. Each piezoelectric crystals or piezoelectric fiber group 104 is energized by a high voltage pulse generator 100 that when energized produce an acoustic pressure shock wave directed toward the focal point ($F_2$) 52 of the ellipsoidal reflector 50 (see FIG. 5). When all piezoelectric crystals or piezoelectric fiber group 104 are energized concurrently the multiple acoustic pressure shock waves combine through superposition and interference in the reflector liquid 47 to produce a larger amplitude acoustic pressure shock wave 17 (see FIG. 5). Each of the acoustic pressure shock wave generating devices 16, similar to FIG. 8, FIG. 9 and FIG. 7B, are augmented by six of the pressurized water jets nozzles 41 to assist in the removal of the marine or aquatic fouling organism layer 19 and biofilm layer 59 (see FIG. 5). All other features and functions of the embodiment in FIG. 10 are identical to FIG. 8.

Figure 11:
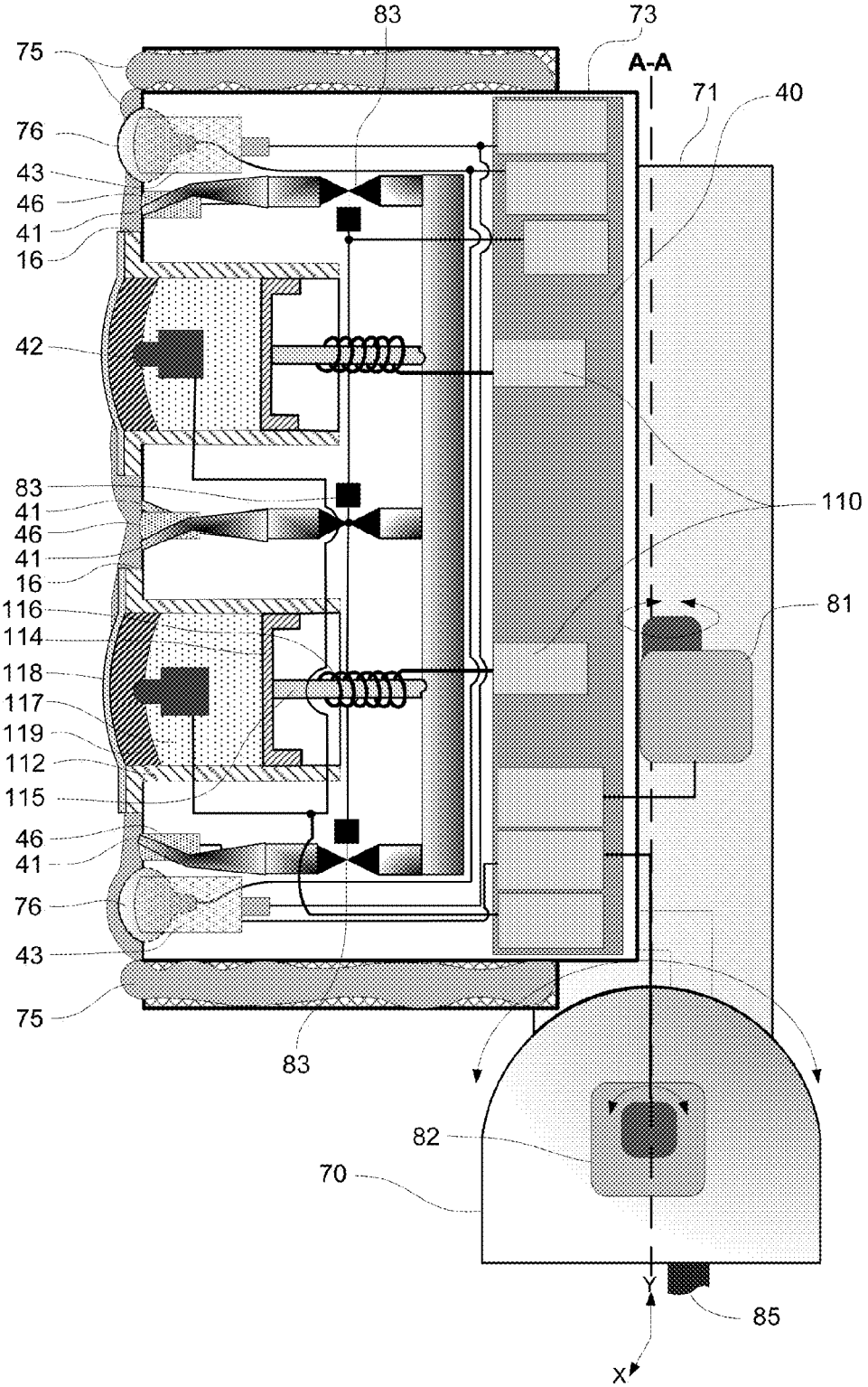
FIG. 11 is a perspective schematic view along the section plane A-A of the cleaning or grooming and inspection module from FIG. 7B that uses an electromagnetic force to create an acoustic pressure shock wave according to one embodiment of the present invention.

The drawing of FIG. 11 is another embodiment of a cross sectional A-A view of an outer inspection and cleaning or grooming module 73 of FIG. 7. The differences from the previous embodiments is that the two acoustic pressure shock wave generating devices 16 utilize a different source of energy than FIG. 8, FIG. 9, and FIG. 10 to create acoustic pressure shock waves 17 (see FIG. 5). In the embodiment of FIG. 11 a piston cylinder 112 encloses an electromagnetic driven piston 114 and a cylinder fluid 116, with the later being sealed by a diaphragm 118. The piston power source 110 generates a high frequency pulse into the piston coil 116 that in turn drives the magnetic piston rod 115 connected to piston 114 rapidly toward the diaphragm 118 through electromagnetic force creating an acoustic planar wave (not shown in FIG. 11 to maintain the clarity of the figure). The resulting acoustic planar wave is moving in the fluid-filled cavity 117 towards the acoustic lens 119 that is focusing the planar wave and thus creating acoustic pressure shock waves 17 (as described in FIG. 5) that are focused towards the targeted area. Each of the shock wave generating devices 16, as in FIG. 8, and FIG. 9, FIG. 10 and FIG. 7B, are augmented by six of the pressurized water jets nozzles 41 to assist in the removal of the marine or aquatic fouling organism layer 19 and biofilm layer 59 (see FIG. 5). AH other features and functions of the embodiment in FIG. 11 are identical to FIG. 8.

Figure 12:
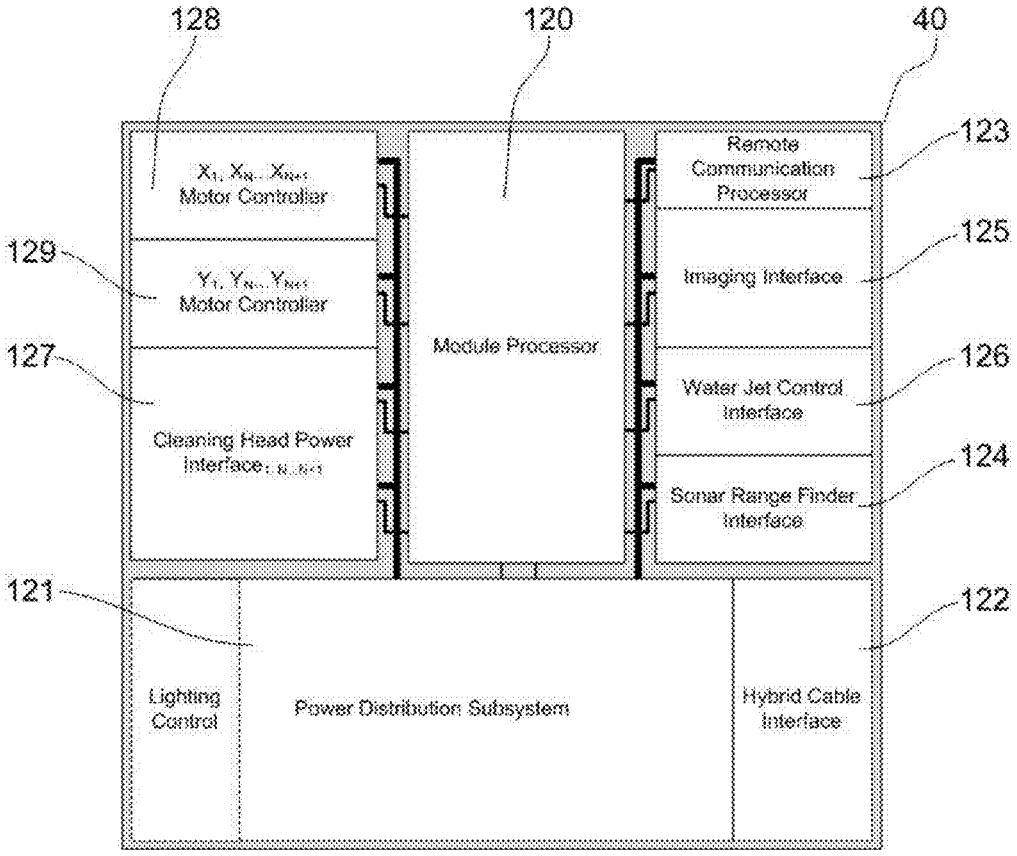
FIG. 12 is a schematic representation of the electronic subsystems contained in the inspection and cleaning or grooming module of FIG. 4A or contained in the outer left and right inspection and cleaning or grooming modules depicted in FIG. 7B according to one embodiment of the present invention.

The drawing of FIG. 12 is a diagram of a control and power system 40 that is contained in the inspection and cleaning or grooming module 15 of FIG. 4B or the outer inspection and cleaning or grooming modules 73 of FIG. 7B. The module processor 120 can contain expert system software to perform the inspection and cleaning or grooming autonomously, or be partially controlled by the remote operator's station 32, as described in FIG. 3. In a partially controlled system, the remote operator's station 32 would communicate the high level command to invoke a task and the module processor 120 would perform all of the low level actions in support of the task. The low level actions would be part of the module processor's 120 inherent knowledge base.

In order to provide a directional capability for inspection and cleaning or grooming each acoustic pressure shock wave generator 16 in FIG. 4A requires an X-axis motor controller 128 and Y-axis motor controller 129 (both shown in FIG. 12) to tilt the direction of the reflector 24 in FIG. 4B either vertically or laterally, respectively, toward the specific cleaning or grooming target. There would be seven X-axis motor controllers 128 and seven Y-axis motor controllers 129 to support the seven acoustic pressure shock wave generator 16 in the embodiment of FIG. 4A. In the embodiment of FIG. 7B, FIG. 8, FIG. 9, FIG. 10 and FIG. 11, there is one X-axis motor controller 128 needed to rotate both of the outer inspection and cleaning or grooming modules 73 and the center inspection and cleaning or grooming module 72 together about the X axis, and two Y-axis motor controller 129 to rotate independently each of outer inspection and cleaning or grooming modules 73 about their Y axis.

Figure 13:
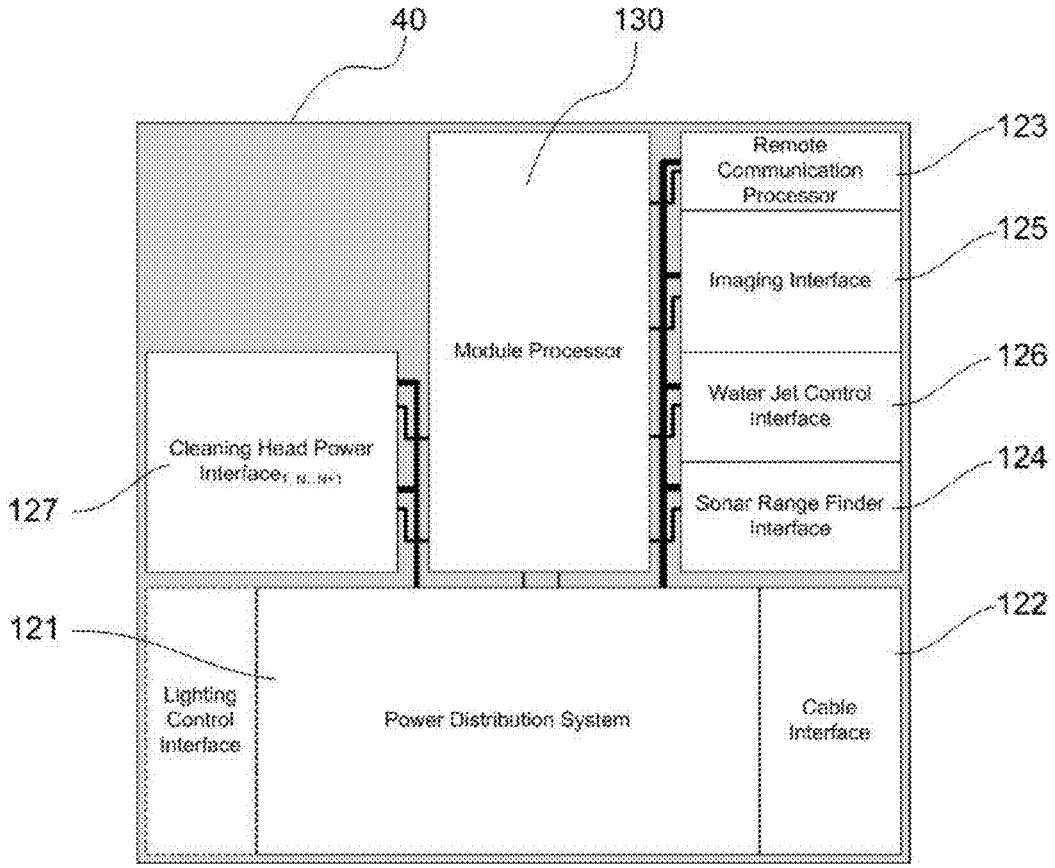
FIG. 13 is a schematic representation of the electronic subsystems contained in the center inspection and cleaning or grooming module depicted in FIG. 7B according to one embodiment of the present invention.

The diagrams of FIG. 12 and FIG. 13 contain the power distribution subsystem 121 to create the specific power sources needed by the inspection and cleaning or grooming modules 15 of FIG. 4B or modules 72 and 73 of FIG. 7B and a hybrid cable interface 122 to connect to the electrical cables and hoses supplied by the remote cleaning or grooming vehicle 10 in FIG. 1 or FIG. 2, or the inspection and cleaning or grooming vehicle 30 in FIG. 7A. A remote communication processor 123 is present in the diagram of FIG. 12 and FIG. 13 to facilitate fast communication with the remote operator's station 32 and offload that task from the module processor 120. To support the inspection activities the diagram contains a lighting control function (dotted box) integrated in the power distribution subsystem 121 to adjust the intensity of the underwater lighting, a sonar range finder interface 124 to measure distance to an object and also to prevent collision with an underwater structure, and an imaging interface 125 to process the output from the closed-circuit camera(s) and fluorometric sensor(s). The imaging interface 125 may process the inspection images itself to make autonomous decisions regarding cleaning or grooming or can forward the images to remote operator's station 32 using an optical fiber connection or a wireless connection. To support the cleaning or grooming functions of the module, a water jet interface 126 is provided to enable turning the water jets on and off, or if the jet nozzle can be rotated as in FIG. 3A the water jet control interface 126 would perform that function as well. A cleaning or grooming head power interface 127 provides the specialized power to each shock wave generator 16 (in FIG. 3A and FIG. 7B). This specialized power would be in the form that is compatible with the mode of generating the shock wave, i.e. electrode discharge in FIG. 8, laser heating in FIG. 9, piezoelectric fiber excitation described for FIG. 10, or the electromagnetic excitation utilized in FIG. 11.

The module processor 120 of FIG. 12 controls the voltage output level, the repetition rate and the enabling of the cleaning or grooming head power interface 127. In the embodiment of FIG. 4A there would be seven cleaning or grooming head power interfaces 127 to support each acoustic pressure shock wave generator 16. To support the embodiment of FIG. 7B there would be two cleaning or grooming head power interfaces 127 for each of the outer inspection and cleaning modules 73.

The drawing of FIG. 13 is a diagram of a control and power system 40 contained in the center inspection and cleaning or grooming module 72 of FIG. 7B. There is an inter-module communication link 131 between the center inspection and cleaning or grooming module 72 and the outer inspection and cleaning or grooming modules 73 (of FIG. 7B) to provide a master and slave control system hierarchy. The center inspection and cleaning or grooming module 72 in this embodiment is the master and the outer inspection and cleaning or grooming modules 73 would be the slaves. The purpose being that the central module processor 130 of the center inspection and cleaning or grooming module 72 would be the initiator in managing the coordination of tasks through the use of the expert system software it contains, or the receipt of commands from the remote operator's station 32. This type of communication interface could then eliminate the remote communication processor 123 described in FIG. 12. The remainder of the diagram and functions of FIG. 13 is the same as FIG. 12 with the exception there are no x/y motor controllers needed.

While the invention has been described with reference to exemplary structures and methods in embodiments, the invention is not intended to be limited thereto, but to extend to modifications and improvements within the scope of equivalence of such claims to the invention.

What is claimed is:

1. An apparatus for cleaning or grooming a submerged surface comprising:

an acoustic pressure shock wave generative device including a reflector and a membrane and configured to produce from a first focal point within the reflector a focused shock wave having a compression phase with a higher pressure amplitude than a second tensile phase that follows and is longer-lasting than the compression phase;

a control mechanism for the shock wave generative device configured to control accumulative energy of shock waves in a target focal volume to an energy level that removes targeted undesirable material covering a submerged surface in the target focal volume without imparting material stress, paint damage or coating damage to the underlying submerged surface in the target focal volume, wherein the target focal volume includes a second focal point forming a line with the first focal point that coincides with a semi-axis of the reflector;

a remotely operated underwater vehicle coupled to the acoustic pressure shock wave generating device; and an inspection and cleaning or grooming module including one or more underwater sensors configured to detect distance between the acoustic pressure shock wave generating device and the submerged surface, wherein the inspection and cleaning or grooming module is operative coupled to a control system that activates the acoustic pressure shock wave generative device and directs the remotely operated underwater vehicle.

2. The apparatus of claim 1, further comprising a plurality of acoustic pressure shock wave generative devices each configured to produce a focused shock wave with having a compression phase with a higher pressure amplitude than a second tensile phase that follows and is longer-lasting than the compression phase.

3. The apparatus of claim 1, wherein the inspection cleaning or grooming module includes one or more lights and one or more cameras.

4. The apparatus of claim 1, wherein the inspection cleaning or grooming module includes one or more fluid jet nozzles.

5. The apparatus of claim 1, wherein the acoustic pressure shock wave generative device includes an anode and cathode of an electrohydraulic shock wave generator.

6. The apparatus of claim 1, wherein the acoustic pressure shock wave generative device includes a laser.

7. The apparatus of claim 1, wherein the acoustic pressure shock wave generative device includes piezoelectric fibers or piezoelectric crystal composite structure.

8. The apparatus of claim 1, wherein the acoustic pressure shock wave generative device includes electromagnets.

9. The apparatus of claim 1, wherein the acoustic pressure shock wave generative device includes an elliptical reflector.

10. The apparatus of claim 1, wherein the acoustic pressure shock wave generative device includes a parabolic reflector.

11. The apparatus of any of claims 1 to 10, wherein the acoustic pressure shock wave generative device includes a tiltable reflector configured to adjust the location of the target focal volume by the control system adjusting the line between the first and second focal points to a specific angle.

12. A method comprising applying focused acoustic pressure shock waves underwater to a submerged surface in a target focal volume whereby the submerged surface is cleaned or groomed by application of the acoustic pressure shock waves, wherein the focused acoustic pressure waves have a compression phase with a higher pressure amplitude than a second tensile phase that follows and is longer-lasting than the compression phase, and wherein accumulative energy of shock waves in a target focal volume is controlled to remove undesirable material covering the submerged surface in the target focal volume without imparting material stress, paint damage or coating damage to the underlying submerged surface in the target focal volume.

13. The method of claim 12, further comprising remotely detecting a location on the submerged surface to direct the acoustic pressure shock waves and articulating one or more acoustic pressure shock wave generating devices to apply the acoustic pressure shock waves to said location.

14. The method of claim 12, further comprising remotely controlling accumulative energy delivered by one or more acoustic pressure shock wave generating devices that apply the acoustic pressure shock waves to the submerged structure.

15. The method of claim 12, further comprising using inspection and control software in conjunction with a control system to apply the acoustic pressure shock waves to a desired location on the submerged surface.

16. The method of claim 12, further comprising using one or more fluid jet nozzles to enhance cleaning or grooming by acoustic pressure shock waves.

17. The method of claim 12, further comprising vacuuming debris dislodged from the submerged surface.

18. The method of claim 12, wherein the acoustic pressure shock waves are applied by an electrohydraulic acoustic pressure shock wave generating device.

19. The method of claim 12, wherein the acoustic pressure shock waves are applied by an electromagnetic acoustic pressure shock wave generating device.

20. The method of claim 12, wherein the shock waves are applied by a laser acoustic pressure shock wave generating device.

21. The method of claim 12, wherein the shock waves are applied by an piezoelectric fibers or piezoelectric crystals acoustic pressure shock wave generating device.

22. The method of any of claims 12 to 21, further comprising applying the acoustic pressure shock waves through a a coupling membrane between an acoustic pressure shock wave generating device and the submerged surface.

23. The method of any of claims 12 to 21 wherein the submerged surface is part of a ship, boat, watercraft, or platform structure.

24. The method of any of claims 12 to 21 wherein the submerged surface cleaned or groomed by acoustic pressure shock waves is at least one of metal, fiberglass, plastic, wood and cement.

* * * * *